US011506454B2

(12) United States Patent
Pierre, Jr.

(10) Patent No.: US 11,506,454 B2
(45) Date of Patent: Nov. 22, 2022

(54) HEAT EXCHANGER CONFIGURATION FOR A HIGH PRESSURE EXPANDER PROCESS AND A METHOD OF NATURAL GAS LIQUEFACTION USING THE SAME

(71) Applicant: Fritz Pierre, Jr., Humble, TX (US)

(72) Inventor: Fritz Pierre, Jr., Humble, TX (US)

(73) Assignee: ExxonMobile Upstream Research Company, Spring, TX (US)

( * ) Notice: Subject to any disclaimer, the term of this patent is extended or adjusted under 35 U.S.C. 154(b) by 521 days.

(21) Appl. No.: 16/526,454

(22) Filed: Jul. 30, 2019

(65) Prior Publication Data

US 2020/0064060 A1 Feb. 27, 2020

Related U.S. Application Data

(60) Provisional application No. 62/721,374, filed on Aug. 22, 2018.

(51) Int. Cl.

| | |
|---|---|
| ***F25J 1/02*** | (2006.01) |
| ***F25J 1/00*** | (2006.01) |
| ***F25B 9/10*** | (2006.01) |

(52) U.S. Cl.

CPC ..... *F25J 1/007* (2013.01); *F25B 9/10* (2013.01); *F25J 1/0022* (2013.01); *F25J 1/0221* (2013.01);

(Continued)

(58) Field of Classification Search

CPC ..... F25J 1/0022; F25J 1/0221; F25J 1/0297; F25J 1/0268; F25J 1/0295; F25J 1/0205; F25J 1/0204; F25J 2215/60

See application file for complete search history.

(56) References Cited

U.S. PATENT DOCUMENTS 1,914,337 A 6/1933 Belt
1,974,145 A 9/1934 Atwell ..... 183/120

(Continued)

FOREIGN PATENT DOCUMENTS

CN 102628635 10/2014 ..... F25J 3/08
CN 106642985 5/2017

(Continued)

OTHER PUBLICATIONS

Fantolina, A. et al., (2012) "Use Dynamic Simulation for Advanced LNG Plant Design," Hydrological Processing, pp. 81-86.

(Continued)

*Primary Examiner* — Brian M King
(74) *Attorney, Agent, or Firm* — ExxonMobil Upstream Research Company—Law Department

(57) ABSTRACT

A method for liquefying a feed gas stream. A compressed first refrigerant stream is cooled and expanded to produce an expanded first refrigerant stream. The feed gas stream is cooled to within a first temperature range by exchanging heat only with the expanded first refrigerant stream to form a liquefied feed gas stream and a warmed first refrigerant stream. A compressed second refrigerant stream is provided is cooled to produce a cooled second refrigerant stream. At least a portion of the cooled second refrigerant stream is further cooled by exchanging heat with the expanded first refrigerant stream, and then is expanded to form an expanded second refrigerant stream. The liquefied feed gas stream is cooled to within a second temperature range by exchanging heat with the expanded second refrigerant stream to form a sub-cooled LNG stream and a first warmed, second refrigerant stream.

3 Claims, 9 Drawing Sheets

(52) U.S. Cl.
CPC ..... *F25J 1/0254* (2013.01); *F25J 1/0262* (2013.01); *F25J 1/0297* (2013.01)

(56) References Cited

U.S. PATENT DOCUMENTS

| | | | | |
|---|---|---|---|---|
| 2,007,271 | A | 7/1935 | Frankl | 62/175.5 |
| 2,011,550 | A | 8/1935 | Hasche | 62/121 |
| 2,321,262 | A | 6/1943 | Taylor | 62/140 |
| 2,475,255 | A | 7/1949 | Rollman | 62/170 |
| 2,537,045 | A | 1/1951 | Garbo | 62/122 |
| 3,014,082 | A | 12/1961 | Woertz, III | 260/676 |
| 3,103,427 | A | 9/1963 | Jennings | 62/39 |
| 3,180,709 | A | 4/1965 | Yendall et al. | 23/210 |
| 3,347,055 | A | 10/1967 | Blanchard et al. | 62/9 |
| 3,370,435 | A | 2/1968 | Arregger | 62/28 |
| 3,400,512 | A | 9/1968 | McKay | 55/69 |
| 3,400,547 | A | 9/1968 | Williams et al. | 62/55 |
| 3,478,529 | A | 11/1969 | Boykin | |
| 3,511,058 | A | 5/1970 | Becker | 62/9 |
| 3,724,226 | A | 4/1973 | Pachaly | 62/39 |
| 3,878,689 | A | 4/1975 | Grenci | 62/9 |
| 4,281,518 | A | 8/1981 | Muller et al. | 62/12 |
| 4,415,345 | A | 11/1983 | Swallow | 62/28 |
| 4,609,388 | A | 9/1986 | Adler et al. | 62/12 |
| 4,769,054 | A | 9/1988 | Steigman | 62/12 |
| 5,025,860 | A | 6/1991 | Mandrin | 166/267 |
| 5,137,558 | A | 8/1992 | Agrawal | 62/24 |
| 5,139,547 | A | 8/1992 | Agrawal et al. | 62/8 |
| 5,141,543 | A | 8/1992 | Agrawal et al. | 62/8 |
| 5,638,698 | A | 6/1997 | Knight et al. | 62/632 |
| 5,950,453 | A | 9/1999 | Bowen et al. | 62/612 |
| 6,003,603 | A | 12/1999 | Breivik et al. | 166/357 |
| 6,158,242 | A | 12/2000 | Lu | 62/637 |
| 6,295,838 | B1 | 10/2001 | Shah et al. | 62/643 |
| 6,298,688 | B1 | 10/2001 | Brostow et al. | 62/613 |
| 6,308,531 | B1 | 10/2001 | Roberts et al. | |
| 6,412,302 | B1 | 7/2002 | Foglietta | 62/611 |
| 6,662,589 | B1 | 12/2003 | Roberts et al. | 62/425 |
| 6,889,522 | B2 | 5/2005 | Prible et al. | 62/612 |
| 7,127,914 | B2 | 10/2006 | Roberts et al. | |
| 7,143,606 | B2 | 12/2006 | Trainer | 62/611 |
| 7,278,281 | B2 | 10/2007 | Yang et al. | 62/612 |
| 7,386,996 | B2 | 6/2008 | Fredheim et al. | 62/612 |
| 7,520,143 | B2 | 4/2009 | Spilsbury | 62/620 |
| 7,712,331 | B2 | 5/2010 | Dee et al. | 62/612 |
| 8,079,321 | B2 | 12/2011 | Balasubramanian | 114/74 |
| 8,435,403 | B2 | 5/2013 | Sapper et al. | 208/254 |
| 8,464,289 | B2 | 6/2013 | Pan | 725/34 |
| 8,601,833 | B2 | 12/2013 | Dee et al. | 62/648 |
| 8,616,012 | B2 | 12/2013 | Duerr et al. | 62/89 |
| 8,616,021 | B2 | 12/2013 | Minta | |
| 8,747,520 | B2 | 6/2014 | Bearden et al. | 95/41 |
| 9,016,088 | B2 | 4/2015 | Butts | 62/613 |
| 9,121,636 | B2 | 9/2015 | Mock et al. | |
| 9,140,490 | B2 | 9/2015 | Minta et al. | |
| 9,339,752 | B2 | 5/2016 | Reddy et al. | |
| 9,435,229 | B2 | 9/2016 | Alekseev et al. | 60/643 |
| 9,439,077 | B2 | 9/2016 | Gupta et al. | |
| 9,459,042 | B2 | 10/2016 | Chantant et al. | 62/50.2 |
| 9,506,690 | B2 | 11/2016 | Paradowski et al. | |
| 2006/0000615 | A1 | 1/2006 | Choi | 166/352 |
| 2007/0277674 | A1 | 12/2007 | Hirano et al. | 95/290 |
| 2009/0217701 | A1 | 9/2009 | Minta et al. | 62/612 |
| 2010/0107684 | A1* | 5/2010 | Minta | F25J 1/0297 62/623 |
| 2010/0126214 | A1* | 5/2010 | Paradowski | F25J 1/0204 62/612 |
| 2010/0192626 | A1 | 8/2010 | Chantant | 62/606 |
| 2010/0251763 | A1 | 10/2010 | Audun | 62/614 |
| 2011/0036121 | A1 | 2/2011 | Roberts et al. | 62/612 |
| 2011/0126451 | A1 | 6/2011 | Pan et al. | 44/451 |
| 2011/0259044 | A1 | 10/2011 | Baudat et al. | 62/611 |
| 2012/0285196 | A1 | 11/2012 | Flinn et al. | 62/620 |
| 2013/0074541 | A1 | 3/2013 | Kaminsky et al. | 62/601 |
| 2013/0199238 | A1 | 8/2013 | Mock et al. | 62/611 |
| 2014/0130542 | A1 | 5/2014 | Brown et al. | 62/612 |
| 2015/0285553 | A1 | 10/2015 | Oelfke et al. | 62/611 |
| 2017/0010041 | A1 | 1/2017 | Pierre, Jr. et al. | 62/616 |
| 2017/0016667 | A1 | 1/2017 | Huntington et al. | 62/614 |
| 2017/0016668 | A1 | 1/2017 | Pierre, Jr. et al. | 62/614 |
| 2017/0160008 | A9 | 6/2017 | Kikkawa et al. | |
| 2017/0167785 | A1 | 6/2017 | Pierre, Jr. et al. | 62/613 |
| 2017/0167786 | A1 | 6/2017 | Pierre, Jr. | 62/613 |
| 2017/0167787 | A1 | 6/2017 | Pierre, Jr. et al. | 62/614 |
| 2017/0167788 | A1 | 6/2017 | Pierre, Jr. et al. | 62/620 |

FOREIGN PATENT DOCUMENTS

| | | | |
|---|---|---|---|
| DE | 1960515 | 5/1971 | F25J 1/02 |
| DE | 2354726 | 5/1975 | F17C 9/04 |
| DE | 3149847 | 7/1983 | B01D 5/00 |
| DE | 19906602 | 8/2000 | F25J 3/08 |
| DE | 102013007208 | 10/2014 | B01D 3/14 |
| EP | 1715267 | 10/2006 | F25J 3/02 |
| EP | 1972875 | 9/2008 | F25J 3/04 |
| EP | 2157013 | 8/2009 | F17C 3/02 |
| EP | 2629035 | 8/2013 | F25J 1/00 |
| FR | 2756368 | 5/1998 | B01D 53/26 |
| GB | 1376678 | 12/1974 | F25J 1/02 |
| GB | 1596330 | 8/1981 | F25J 1/02 |
| GB | 2172388 | 9/1986 | E21B 43/16 |
| GB | 2333148 | 7/1999 | F25J 1/02 |
| GB | 2470062 | 11/2010 | F25J 1/02 |
| GB | 2486036 | 11/2012 | F25J 1/02 |
| JP | 59216785 | 12/1984 | F25J 1/02 |
| JP | 2530859 | 4/1997 | G02F 1/13 |
| JP | 5705271 | 11/2013 | F25J 3/00 |
| JP | 5518531 | 6/2014 | Y02P 20/152 |
| KR | 2010/0112708 | 10/2010 | F17C 5/00 |
| KR | 2011/0079949 | 7/2011 | F25J 3/02 |
| WO | WO2006/120127 | 11/2006 | F25J 3/02 |
| WO | WO2008/133785 | 11/2008 | B63B 25/08 |
| WO | WO2011/101461 | 8/2011 | B63B 25/16 |
| WO | WO2012/031782 | 3/2012 | F25J 1/02 |
| WO | WO2014/048845 | 4/2014 | F25J 1/00 |
| WO | WO2015/110443 | 7/2015 | F25J 1/00 |
| WO | 2016/151636 | 9/2016 | |
| WO | WO2017/011123 | 1/2017 | F25J 3/08 |
| WO | WO2017/067871 | 4/2017 | F01D 15/10 |

OTHER PUBLICATIONS

Perez, V. et al., (1998) "The 4.5 MMTPA LNG Train—A Cost Effective Design//Train De GNL DE 4.5 MMTPA-UNE Conception Economique," International Conference and Exhibition on Liquefied Natural Gas, pp. 3.7-1-3.7-15.

Salisbury, Roy et al., (2007) "Design Manufacture, and Test Campaign of The World's Largest LNG Refrigeration Compressor Strings" International Conference and Exhibition on Liquefied Natural Gas, pp. 2.1-2.22.

U.S. Appl. No. 62/458,127, filed Feb. 13, 2017, Pierre, Fritz Jr.

U.S. Appl. No. 62/458,131, filed Feb. 13, 2017, Pierre, Fritz Jr.

U.S. Appl. No. 62/463,274, filed Feb. 24, 2017, Kaminsky, Robert D. et al.

U.S. Appl. No. 62/478,961, Balasubramanian, Sathish.

Bach, Wilfried (1990) "Offshore Natural Gas Liquefaction with Nitrogen Cooling—Process Design and Comparison of Coil-Wound and Plate-Fin Heat Exchangers," *Science and Technology Reports*, No. 64, Jan. 1, 1990, pp. 31-37.

Chang, Ho-Myung et al., (2019) "Thermodynamic Design of Methane Liquefaction System Based on Reversed-Brayton Cycle" Cryogenics, pp. 226-234.

ConocoPhillips Liquefied Natural Gas Licensing (2017) "Our Technology And Expertise Are Ready To Work Toward Your LNG Future Today," http://lnglicensing.conocophillips.com/Documents/15-1106%20LNG%20Brochure,,March2016.pdf, Apr. 25, 2017, 5 pgs.

Danish Technologies Institute (2017) "Project—Ice Bank System with Pulsating and Flexible Heat Exchanger (IPFLEX)," https://www.dti.dk/projects/project-ice-bank-system-with-pulsating-andflexible-heat-exchanger-ipflex/37176.

(56) References Cited

OTHER PUBLICATIONS

Diocee, T. S. et al. (2004) "Atlantic LNG Train 4—The Worlds Largest LNG Train", *The 14th International Conference and Exhibition on Liquefied Natural Gas* (*LNG 14*), Doha, Qatar, Mar. 21-24, 2004, 15 pgs.
Khoo, C. T. et al. (2009) "Execution of LNG Mega Trains—The Qatargas 2 Experience," *WCG*, 2009, 8 pages.
Laforte, C et al. (2009) "Tensile, Torsional and Bending Strain at the Adhesive Rupture of an Iced Substrate," *ASME 28th Int'l Conf. on Ocean, Offshore and Arctic Eng.*, OMAE2009-79458, 8 pgs.
McLachlan, Greg (2002) "Efficient Operation of LNG From The Oman LNG Project," *Shell Global Solutions International B.V.*, Jan. 1, 2002, pp. 1-8.
Olsen, Lars et al. (2017).
Ott, C. M. et al. (2015) "Large LNG Trains: Technology Advances to Address Market Challenges", *Gastech*, Singapore, Oct. 27-30, 2015, 10 pgs.
Publication No. 43031 (2000) Research Disclosure, Mason Publications, Hampshire, GB, Feb. 1, 2000, p. 239, XP000969014, ISSN: 0374-4353, paragraphs [0004], [0005] & [0006].
Publication No. 37752 (1995) Research Disclosure, Mason Publications, Hampshire, GB, Sep. 1, 1995, p. 632, XP000536225, ISSN: 0374-4353, 1 page.
Ramshaw, Ian et al. (2009) "The Layout Challenges of Large Scale Floating LNG," *ConocoPhillips Global LNG Collaboration, 2009*, 24 pgs, XP009144486.
Riordan, Frank (1986) "A Deformable Heat Exchanger Separated by a Helicoid," *Journal of Physics A: Mathematical and General*, v. 19.9, pp. 1505-1515.
Roberts, M. J. et al. (2004) "Reducing LNG Capital Cost in Today's Competitive Environment", PS2-6, *The 14th International Conference and Exhibition on Liquefied Natural Gas* (*LNG 14*), Doha, Qatar, Mar. 21-24, 2004, 12 pgs.
Shah, Pankaj et al. (2013) "Refrigeration Compressor Driver Selection and Technology Qualification Enhances Value for the Wheatstone Project," *17th Int'l Conf. & Exh. On LNG*, 27 pgs.
Tan, Hongbo et al. (2016) "Proposal and Design of a Natural Gas Liquefaction Process Recovering the Energy Obtained from the Pressure Reducing Stations of High-Pressure Pipelines," *Cryogenics*, Elsevier, Kidlington, GB, v.80, Sep. 22, 2016, pp. 82-90.
Tsang, T. P. et al. (2009) "Application of Novel Compressor/Driver Configuration in the Optimized Cascade Process," *2009 Spring Mtg. and Global Conf. on Process Safety—9th Topical Conf. on Gas Utilization*, 2009, Abstract, 1 pg. https://www.aiche.org/conferences/aiche-spring-meeting-and-globalcongress-on-process-safety/2009/proceeding/paper/7a-application-novel-compressordriver-configurationoptimized-cascader-process.
Tianbiao, He et al. (2015), Optimal Synthesis of Expansion Liquefaction Cycle for Distributed-Scale LNG, *Institute of Refrigeration and Cryogenics, Shanghai Jiao Tong University*, pages 268-280.

* cited by examiner

HEAT EXCHANGER CONFIGURATION FOR A HIGH PRESSURE EXPANDER PROCESS AND A METHOD OF NATURAL GAS LIQUEFACTION USING THE SAME

CROSS-REFERENCE TO RELATED APPLICATIONS

This application claims the priority benefit of U.S. Provisional Application No. 62/721,374, "Heat Exchanger Configuration for a High Pressure Expander Process and a Method of Natural Gas Liquefaction Using the Same," filed Aug. 22, 2018; U.S. Provisional Application No. 62/565,725, "Natural Gas Liquefaction by a High Pressure Expansion Process", filed Sep. 29, 2017; U.S. Provisional Application No. 62/565,733, "Natural Gas Liquefaction by a High Pressure Expansion Process," filed Sep. 29, 2017; and U.S. Provisional Application No. 62/576,989, "Natural Gas Liquefaction by a High Pressure Expansion Process Using Multiple Turboexpander Compressors", filed Oct. 25, 2017, the disclosures of which are incorporated by reference herein in their entireties for all purposes.

This application is related to U.S. Provisional Application No. 62/721,367, "Managing Make-up Gas Composition Variation for a High Pressure Expander Process; and U.S. Provisional Application No. 62/721,375, "Primary Loop Start-up Method for a High Pressure Expander Process", having common ownership and filed on an even date, the disclosures of which are incorporated by reference herein in their entireties for all purposes.

BACKGROUND

Field of Disclosure

The disclosure relates generally to liquefied natural gas (LNG) production. More specifically, the disclosure relates to LNG production at high pressures.

Description of Related Art

This section is intended to introduce various aspects of the art, which may be associated with the present disclosure. This discussion is intended to provide a framework to facilitate a better understanding of particular aspects of the present disclosure. Accordingly, it should be understood that this section should be read in this light, and not necessarily as an admission of prior art.

Because of its clean burning qualities and convenience, natural gas has become widely used in recent years. Many sources of natural gas are located in remote areas, which are great distances from any commercial markets for the gas. Sometimes a pipeline is available for transporting produced natural gas to a commercial market. When pipeline transportation is not feasible, produced natural gas is often processed into liquefied natural gas (LNG) for transport to market.

In the design of an LNG plant, one of the most important considerations is the process for converting the natural gas feed stream into LNG. Currently, the most common liquefaction processes use some form of refrigeration system. Although many refrigeration cycles have been used to liquefy natural gas, the three types most commonly used in LNG plants today are: (1) the "cascade cycle," which uses multiple single component refrigerants in heat exchangers arranged progressively to reduce the temperature of the gas to a liquefaction temperature; (2) the "multi-component refrigeration cycle," which uses a multi-component refrigerant in specially designed exchangers; and (3) the "expander cycle," which expands gas from feed gas pressure to a low pressure with a corresponding reduction in temperature. Most natural gas liquefaction cycles use variations or combinations of these three basic types.

The refrigerants used in liquefaction processes may comprise a mixture of components such as methane, ethane, propane, butane, and nitrogen in multi-component refrigeration cycles. The refrigerants may also be pure substances such as propane, ethylene, or nitrogen in "cascade cycles." Substantial volumes of these refrigerants with close control of composition are required. Further, such refrigerants may have to be imported and stored, which impose logistics requirements, especially for LNG production in remote locations. Alternatively, some of the components of the refrigerant may be prepared, typically by a distillation process integrated with the liquefaction process.

The use of gas expanders to provide the feed gas cooling, thereby eliminating or reducing the logistical problems of refrigerant handling, is seen in some instances as having advantages over refrigerant-based cooling. The expander system operates on the principle that the refrigerant gas can be allowed to expand through an expansion turbine, thereby performing work and reducing the temperature of the gas. The low temperature gas is then heat exchanged with the feed gas to provide the refrigeration needed. The power obtained from cooling expansions in gas expanders can be used to supply part of the main compression power used in the refrigeration cycle. The typical expander cycle for making LNG operates at the feed gas pressure, typically under about 6,895 kPa (1,000 psia). Supplemental cooling is typically needed to fully liquefy the feed gas and this may be provided by additional refrigerant systems, such as secondary cooling and/or sub-cooling loops. For example, U.S. Pat. Nos. 6,412,302 and 5,916,260 present expander cycles which describe the use of nitrogen as refrigerant in the sub-cooling loop.

Previously proposed expander cycles have all been less efficient thermodynamically, however, than the current natural gas liquefaction cycles based on refrigerant systems. Expander cycles have therefore not offered any installed cost advantage to date, and liquefaction cycles involving refrigerants are still the preferred option for natural gas liquefaction.

Because expander cycles result in a high recycle gas stream flow rate and high inefficiency for the primary cooling (warm) stage, gas expanders have typically been used to further cool feed gas after it has been pre-cooled to temperatures well below −20° C. using an external refrigerant in a closed cycle, for example. Thus, a common factor in most proposed expander cycles is the requirement for a second, external refrigeration cycle to pre-cool the gas before the gas enters the expander. Such a combined external refrigeration cycle and expander cycle is sometimes referred to as a "hybrid cycle." While such refrigerant-based pre-cooling eliminates a major source of inefficiency in the use of expanders, it significantly reduces the benefits of the expander cycle, namely the elimination of external refrigerants.

U. S. Patent Application US2009/0217701 introduced the concept of using high pressure within the primary cooling loop to eliminate the need for external refrigerant and improve efficiency, at least comparable to that of refrigerant-based cycles currently in use. The high pressure expander process (HPXP), disclosed in U. S. Patent Application US2009/0217701, is an expander cycle which uses high pressure expanders in a manner distinguishing from other expander cycles. A portion of the feed gas stream may be extracted and used as the refrigerant in either an open loop or closed loop refrigeration cycle to cool the feed gas stream below its critical temperature. Alternatively, a portion of LNG boil-off gas may be extracted and used as the refrigerant in a closed loop refrigeration cycle to cool the feed gas stream below its critical temperature. This refrigeration cycle is referred to as the primary cooling loop. The primary cooling loop is followed by a sub-cooling loop which acts to further cool the feed gas. Within the primary cooling loop, the refrigerant is compressed to a pressure greater than 1,500 psia, or more preferably, to a pressure of approximately 3,000 psia. The refrigerant is then cooled against an ambient cooling medium (air or water) prior to being near isentropically expanded to provide the cold refrigerant needed to liquefy the feed gas.

FIG. 1 depicts an example of a known HPXP liquefaction process 100, and is similar to one or more processes disclosed in U. S. Patent Application US2009/0217701. In FIG. 1, an expander loop 102 (i.e., an expander cycle) and a sub-cooling loop 104 are used. Feed gas stream 106 enters the HPXP liquefaction process at a pressure less than about 1,200 psia, or less than about 1,100 psia, or less than about 1,000 psia, or less than about 900 psia, or less than about 800 psia, or less than about 700 psia, or less than about 600 psia. Typically, the pressure of feed gas stream 106 will be about 800 psia. Feed gas stream 106 generally comprises natural gas that has been treated to remove contaminants using processes and equipment that are well known in the art.

In the expander loop 102, a compression unit 108 compresses a refrigerant stream 109 (which may be a treated gas stream) to a pressure greater than or equal to about 1,500 psia, thus providing a compressed refrigerant stream 110. Alternatively, the refrigerant stream 109 may be compressed to a pressure greater than or equal to about 1,600 psia, or greater than or equal to about 1,700 psia, or greater than or equal to about 1,800 psia, or greater than or equal to about 1,900 psia, or greater than or equal to about 2,000 psia, or greater than or equal to about 2,500 psia, or greater than or equal to about 3,000 psia, thus providing compressed refrigerant stream 110. After exiting compression unit 108, compressed refrigerant stream 110 is passed to a cooler 112 where it is cooled by indirect heat exchange with a suitable cooling fluid to provide a compressed, cooled refrigerant stream 114. Cooler 112 may be of the type that provides water or air as the cooling fluid, although any type of cooler can be used. The temperature of the compressed, cooled refrigerant stream 114 depends on the ambient conditions and the cooling medium used, and is typically from about 35° F. to about 105° F. Compressed, cooled refrigerant stream 114 is then passed to an expander 116 where it is expanded and consequently cooled to form an expanded refrigerant stream 118. Expander 116 is a work-expansion device, such as a gas expander, which produces work that may be extracted and used for compression. Expanded refrigerant stream 118 is passed to a first heat exchanger 120, and provides at least part of the refrigeration duty for first heat exchanger 120. Upon exiting first heat exchanger 120, expanded refrigerant stream 118 is fed to a compression unit 122 for pressurization to form refrigerant stream 109.

Feed gas stream 106 flows through first heat exchanger 120 where it is cooled, at least in part, by indirect heat exchange with expanded refrigerant stream 118. After exiting first heat exchanger 120, the feed gas stream 106 is passed to a second heat exchanger 124. The principal function of second heat exchanger 124 is to sub-cool the feed gas stream. Thus, in second heat exchanger 124 the feed gas stream 106 is sub-cooled by sub-cooling loop 104 (described below) to produce sub-cooled stream 126. Sub-cooled stream 126 is then expanded to a lower pressure in expander 128 to form a liquid fraction and a remaining vapor fraction. Expander 128 may be any pressure reducing device, including, but not limited to a valve, control valve, Joule Thompson valve, Venturi device, liquid expander, hydraulic turbine, and the like. The sub-cooled stream 126, which is now at a lower pressure and partially liquefied, is passed to a surge tank 130 where the liquefied fraction 132 is withdrawn from the process as an LNG stream 134, which has a temperature corresponding to the bubble point pressure. The remaining vapor fraction (flash vapor) stream 136 may be used as fuel to power the compressor units.

In sub-cooling loop 104, an expanded sub-cooling refrigerant stream 138 (preferably comprising nitrogen) is discharged from an expander 140 and drawn through second and first heat exchangers 124, 120. Expanded sub-cooling refrigerant stream 138 is then sent to a compression unit 142 where it is re-compressed to a higher pressure and warmed. After exiting compression unit 142, the re-compressed sub-cooling refrigerant stream 144 is cooled in a cooler 146, which can be of the same type as cooler 112, although any type of cooler may be used. After cooling, the re-compressed sub-cooling refrigerant stream is passed to first heat exchanger 120 where it is further cooled by indirect heat exchange with expanded refrigerant stream 118 and expanded sub-cooling refrigerant stream 138. After exiting first heat exchanger 120, the re-compressed and cooled sub-cooling refrigerant stream is expanded through expander 140 to provide a cooled stream which is then passed through second heat exchanger 124 to sub-cool the portion of the feed gas stream to be finally expanded to produce LNG.

U. S. Patent Application US2010/0107684 disclosed an improvement to the performance of the HPXP through the discovery that adding external cooling to further cool the compressed refrigerant to temperatures below ambient conditions provides significant advantages which in certain situations justifies the added equipment associated with external cooling. The HPXP embodiments described in the aforementioned patent applications perform comparably to alternative mixed external refrigerant LNG production processes such as single mixed refrigerant processes. However, there remains a need to further improve the efficiency of the HPXP as well as overall train capacity. There remains a particular need to improve the efficiency of the HPXP in cases where the feed gas pressure is less than 1,200 psia.

U. S. Patent Application 2010/0186445 disclosed the incorporation of feed compression up to 4,500 psia to the HPXP. Compressing the feed gas prior to liquefying the gas in the HPXP's primary cooling loop has the advantage of increasing the overall process efficiency. For a given production rate, this also has the advantage of significantly reducing the required flow rate of the refrigerant within the primary cooling loop which enables the use of compact equipment, which is particularly attractive for floating LNG applications. Furthermore, feed compression provides a means of increasing the LNG production of an HPXP train by more than 30% for a fixed amount of power going to the primary cooling and sub-cooling loops. This flexibility in production rate is again particularly attractive for floating LNG applications where there are more restrictions than land based applications in matching the choice of refrigerant loop drivers with desired production rates.

Notwithstanding the improvements described in the prior art cited above, none of the cited art have described in detail preferred or optimal methods of heat transfer. Additionally, none of the cited art have described preferred or optimal configurations of the main cryogenic heat exchanger used in the HPXP process. As the main cryogenic heat exchanger typically is one of the largest, heaviest, and most costly component in a liquefaction process, any configuration or design that improves liquefaction efficiency and/or reduces any of cost, size, or weight of the main cryogenic heat exchanger would be of benefit or advantage to its users. To achieve these benefits or advantages, there is a need to provide preferred methods of exchanging heat between the warming streams and the cooling streams within the heat exchanger areas of an HPXP-based liquefaction process.

SUMMARY

According to aspects of the disclosure, a method is disclosed for liquefying a feed gas stream rich in methane using a first refrigeration system having a first refrigerant and a second refrigeration system using a second refrigerant. The feed gas stream is provided at a pressure less than 1,200 psia. A compressed first refrigerant stream with a pressure greater than or equal to 1,500 psia is provided, wherein the first refrigerant comprises the compressed first refrigerant stream; the compressed first refrigerant stream is cooled by indirect heat exchange with an ambient temperature air or water, to produce a cooled first refrigerant stream. The cooled first refrigerant stream is expanded in at least one work producing expander, thereby producing an expanded first refrigerant stream. The feed gas stream is cooled to within a first temperature range by exchanging heat only with the expanded first refrigerant stream to form a liquefied feed gas stream and a warmed first refrigerant stream. A compressed second refrigerant stream is provided, comprising the second refrigerant, and the compressed second refrigerant stream is cooled by indirect heat exchange with an ambient temperature air or water, to produce a cooled second refrigerant stream. At least a portion of the cooled second refrigerant stream is further cooled by exchanging heat with the expanded first refrigerant stream to form an additionally cooled, second refrigerant stream. The additionally cooled, second refrigerant stream is expanded to form an expanded second refrigerant stream. The liquefied feed gas stream is cooled to within a second temperature range by exchanging heat with the expanded second refrigerant stream to form a sub-cooled LNG stream and a first warmed, second refrigerant stream.

According to other aspects of the disclosure, a method is provided for liquefying a feed gas stream rich in methane using a first refrigeration system having a first refrigerant and a second refrigeration system having a second refrigerant. The feed gas stream is provided at a pressure less than 1,200 psia. A compressed first refrigerant stream with a pressure greater than or equal to 1,500 psia is provided, wherein the first refrigerant stream comprises the compressed first refrigerant stream. The compressed first refrigerant stream is cooled by indirect heat exchange with an ambient temperature air or water, to produce a cooled first refrigerant stream. The cooled first refrigerant stream is expanded in at least one work producing expander, thereby producing an expanded first refrigerant stream. The expanded first refrigerant stream is separated into a first expanded, first refrigerant stream and a second expanded, first refrigerant stream. The feed gas stream is cooled to within a first temperature range by exchanging heat with the first expanded, first refrigerant stream to form a liquefied feed gas stream, wherein the first expanded, first refrigerant stream only exchanges heat with the feed gas stream to form a first warmed, first refrigerant stream. A compressed second refrigerant stream is provided, comprising the second refrigerant, and the compressed second refrigerant stream is cooled by indirect heat exchange with an ambient temperature air or water, to thereby produce a cooled second refrigerant stream. At least a portion of the cooled second refrigerant stream is further cooled by exchanging heat with the second expanded, first refrigerant stream, to thereby form an additionally cooled, second refrigerant stream and a second warmed, first refrigerant stream. The additionally cooled, second refrigerant stream is expanded to form an expanded second refrigerant stream. The liquefied feed gas stream is cooled to within a second temperature range by exchanging heat with the expanded second refrigerant stream, to thereby form a sub-cooled LNG stream and a first warmed, second refrigerant stream.

According to still other aspects of the disclosure, a method is provided for liquefying a feed gas stream rich in methane using a first refrigeration system having a first refrigerant and a second refrigeration system using a second refrigerant. The feed gas stream is provided at a pressure less than 1,200 psia. A compressed first refrigerant stream with a pressure greater than or equal to 1,500 psia is provided, wherein the compressed first refrigerant stream comprises the first refrigerant. The compressed first refrigerant stream is cooled by indirect heat exchange with an ambient temperature air or water, to produce a cooled first refrigerant stream. The cooled first refrigerant stream is expanded in at least one work producing expander, thereby producing an expanded first refrigerant stream. The feed gas stream is cooled to within a first temperature range by exchanging heat only with the expanded first refrigerant stream, to thereby form a liquefied feed gas stream and a warmed first refrigerant stream. A compressed second refrigerant stream is provided, comprising the second refrigerant, and the compressed second refrigerant stream is cooled by indirect heat exchange with an ambient temperature air or water, to thereby produce a cooled second refrigerant stream. The cooled second refrigerant stream is further cooled by exchanging heat with a first warmed, second refrigerant stream and then separating the further cooled second refrigerant stream into a first cooled, second refrigerant stream and second cooled, second refrigerant stream. The first cooled, second refrigerant stream is further cooled by continuing to exchange heat with the first warmed, second refrigerant stream, to thereby produce a first additionally cooled, second refrigerant stream. The second cooled, second refrigerant stream is further cooled by exchanging heat with the expanded first refrigerant stream, to thereby produce a second additionally cooled, second refrigerant stream. The first additionally cooled, second refrigerant stream and the second additionally cooled, second refrigerant stream are combined and then expanded to thereby form an expanded second refrigerant stream. The liquefied feed gas stream is cooled to within a second temperature range by exchanging heat with the expanded second refrigerant stream, to thereby form a sub-cooled LNG stream and the first warmed, second refrigerant stream.

According to yet other aspects of the disclosure, a method is provided for liquefying a feed gas stream using a first refrigerant stream in a first refrigeration system and a second refrigerant stream in a second refrigeration system, the method also using a first heat exchanger zone and a second heat exchanger zone. The feed gas stream at a pressure less than 1,200 psia. A compressed first refrigerant stream with a pressure greater than or equal to 1,500 psia is provided. The compressed first refrigerant stream is cooled by indirect heat exchange with an ambient temperature air or water to produce a cooled first refrigerant stream. The cooled first refrigerant stream is directed to the second heat exchanger zone to additionally cool the cooled first refrigerant stream below ambient temperature to produce an additionally cooled, first refrigerant stream. The additionally cooled, first refrigerant stream is expanded in at least one work producing expander, thereby producing an expanded first refrigerant stream. The expanded first refrigerant stream is separated into a first expanded, first refrigerant stream and a second expanded, first refrigerant stream. The feed gas stream is cooled within the first heat exchanger zone by exchanging heat with the first expanded, first refrigerant stream to form a liquefied feed gas stream with a temperature within a first temperature range and a first warmed, first refrigerant stream, wherein the first warmed, first refrigerant stream only exchanges heat with the feed gas stream. The first warmed, first refrigerant stream and a second warmed, second refrigerant stream are combined to produce a third warmed, first refrigerant stream. The third warmed, first refrigerant stream is directed to the second heat exchanger zone to cool by indirect heat exchange the cooled first refrigerant stream thereby forming a fourth warmed, first refrigerant stream. A compressed second refrigerant stream is cooled by indirect heat exchange with an ambient temperature air or water to produce a cooled second refrigerant stream. At least a portion of the cooled second refrigerant stream is further cooled within the first heat exchanger zone by exchanging heat with the second expanded, first refrigerant stream to form an additionally cooled, second refrigerant stream and the second warmed, second refrigerant stream. The additionally cooled, second refrigerant stream is expanded to form an expanded second refrigerant stream. The liquefied feed gas stream is cooled within the first heat exchanger zone by exchanging heat with the expanded second refrigerant stream to form a sub-cooled LNG stream with a temperature within a second temperature range and a first warmed, second refrigerant stream.

The foregoing has broadly outlined the features of the present disclosure so that the detailed description that follows may be better understood. Additional features will also be described herein.

BRIEF DESCRIPTION OF THE DRAWINGS

These and other features, aspects and advantages of the disclosure will become apparent from the following description, appending claims and the accompanying drawings, which are briefly described below.

Figure 1:
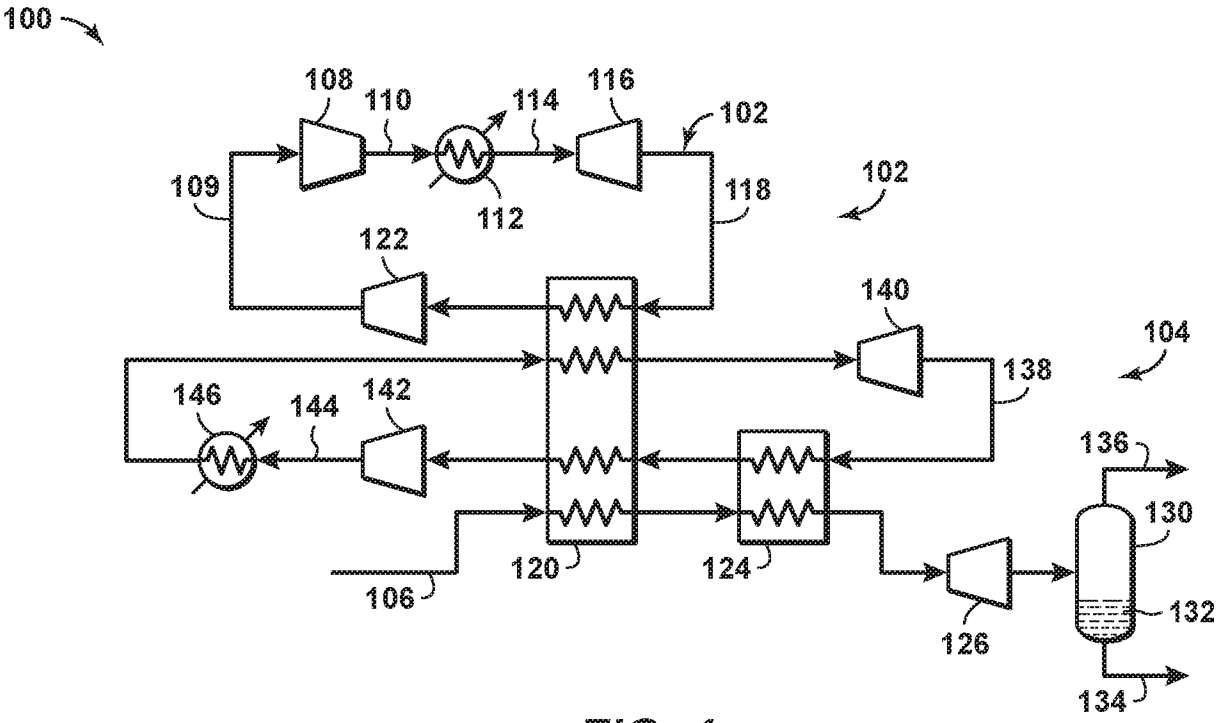
FIG. 1 (Prior Art)
FIG. 1 is a schematic diagram of a system for LNG production according to known principles.

It should be noted that the figures are merely examples and no limitations on the scope of the present disclosure are intended thereby. Further, the figures are generally not drawn to scale, but are drafted for purposes of convenience and clarity in illustrating various aspects of the disclosure.

DETAILED DESCRIPTION

To promote an understanding of the principles of the disclosure, reference will now be made to the features illustrated in the drawings and specific language will be used to describe the same. It will nevertheless be understood that no limitation of the scope of the disclosure is thereby intended. Any alterations and further modifications, and any further applications of the principles of the disclosure as described herein are contemplated as would normally occur to one skilled in the art to which the disclosure relates. For the sake of clarity, some features not relevant to the present disclosure may not be shown in the drawings.

At the outset, for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As one of ordinary skill would appreciate, different persons may refer to the same feature or component by different names. This document does not intend to distinguish between components or features that differ in name only. The figures are not necessarily to scale. Certain features and components herein may be shown exaggerated in scale or in schematic form and some details of conventional elements may not be shown in the interest of clarity and conciseness. When referring to the figures described herein, the same reference numerals may be referenced in multiple figures for the sake of simplicity. In the following description and in the claims, the terms "including" and "comprising" are used in an open-ended fashion, and thus, should be interpreted to mean "including, but not limited to."

The articles "the," "a" and "an" are not necessarily limited to mean only one, but rather are inclusive and open ended so as to include, optionally, multiple such elements.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numeral ranges provided. Accordingly, these terms should be interpreted as indicating that insubstantial or inconsequential modifications or alterations of the subject matter described and are considered to be within the scope of the disclosure. The term "near" is intended to mean within 2%, or within 5%, or within 10%, of a number or amount.

As used herein, the term "ambient" refers to the atmospheric or aquatic environment where an apparatus is disposed. The term "at" or "near" "ambient temperature" as used herein refers to the temperature of the environment in which any physical or chemical event occurs plus or minus ten degrees, alternatively, five degrees, alternatively, three degrees, alternatively two degrees, and alternatively, one degree, unless otherwise specified. A typical range of ambient temperatures is between about 0° C. (32° F.) and about 40° C. (104° F.), though ambient temperatures could include temperatures that are higher or lower than this range. While it is possible in some specialized applications to prepare an environment with particular characteristics, such as within a building or other structure that has a controlled temperature and/or humidity, such an environment is considered to be "ambient" only where it is substantially larger than the volume of heat-sink material and substantially unaffected by operation of the apparatus. It is noted that this definition of an "ambient" environment does not require a static environment. Indeed, conditions of the environment may change as a result of numerous factors other than operation of the thermodynamic engine—the temperature, humidity, and other conditions may change as a result of regular diurnal cycles, as a result of changes in local weather patterns, and the like.

As used herein, the term "compression unit" means any one type or combination of similar or different types of compression equipment, and may include auxiliary equipment, known in the art for compressing a substance or mixture of substances. A "compression unit" may utilize one or more compression stages. Illustrative compressors may include, but are not limited to, positive displacement types, such as reciprocating and rotary compressors for example, and dynamic types, such as centrifugal and axial flow compressors, for example.

"Exemplary" is used exclusively herein to mean "serving as an example, instance, or illustration." Any embodiment or aspect described herein as "exemplary" is not to be construed as preferred or advantageous over other embodiments.

The term "gas" is used interchangeably with "vapor," and is defined as a substance or mixture of substances in the gaseous state as distinguished from the liquid or solid state. Likewise, the term "liquid" means a substance or mixture of substances in the liquid state as distinguished from the gas or solid state.

As used herein, "heat exchange area" means any one type or combination of similar or different types of equipment known in the art for facilitating heat transfer. Thus, a "heat exchange area" may be contained within a single piece of equipment, or it may comprise areas contained in a plurality of equipment pieces. Conversely, multiple heat exchange areas may be contained in a single piece of equipment.

A "hydrocarbon" is an organic compound that primarily includes the elements hydrogen and carbon, although nitrogen, sulfur, oxygen, metals, or any number of other elements can be present in small amounts. As used herein, hydrocarbons generally refer to components found in natural gas, oil, or chemical processing facilities.

As used herein, the terms "loop" and "cycle" are used interchangeably.

As used herein, "natural gas" means a gaseous feedstock suitable for manufacturing LNG, where the feedstock is a methane-rich gas. A "methane-rich gas" is a gas containing methane ($C_1$) as a major component, i.e., having a composition of at least 50% methane by weight. Natural gas may include gas obtained from a crude oil well (associated gas) or from a gas well (non-associated gas).

Embodiments of the present invention provide a process for liquefying natural gas and other methane-rich gas streams to produce liquefied natural gas (LNG) and/or other liquefied methane-rich gases. The term natural gas as used in this specification, including the appended claims, means a gaseous feed stock suitable for manufacturing LNG. The natural gas could comprise gas obtained from a crude oil well (associated gas) or from a gas well (non-associated gas). The composition of natural gas can vary significantly. As used herein, natural gas is a methane-rich gas containing methane ($C_1$) as a major component.

In one or more embodiments of the method for producing LNG herein, a feed gas stream rich in methane is liquefied using a first refrigeration system and a second refrigeration system. The first refrigeration system is used to cool the feed gas stream to within a first temperature range forming a liquefied feed gas stream. The first temperature range is −70° C. to −110° C. The second refrigeration system is then used to cool the liquefied feed gas stream to within a second temperature range forming a sub-cooled LNG stream. The second temperature range is −130° C. to −175° C.

The invention is a method for liquefying a feed gas stream, particularly one rich in methane, using a first refrigerant stream in a first refrigeration system and a second refrigerant stream in a second refrigeration system. A first embodiment of the method comprises: (a) providing the feed gas stream at a pressure less than 1,200 psia; (b) providing a compressed first refrigerant stream with a pressure greater than or equal to 1,500 psia and where the compressed first refrigerant stream is the refrigerant of the first refrigeration system; (c) cooling the compressed first refrigerant stream by indirect heat exchange with an ambient temperature air or water, to produce a cooled first refrigerant stream; (d) expanding the cooled first refrigerant stream in at least one work producing expander, thereby producing an expanded first refrigerant stream; (e) cooling the feed gas stream to within a first temperature range by only exchanging heat with the expanded first refrigerant stream to form a liquefied feed gas stream and a warmed first refrigerant stream; (f) providing a compressed second refrigerant stream, which is the refrigerant of the second refrigeration system, and cooling the compressed second refrigerant stream by indirect heat exchange with an ambient temperature air or water to produce a cooled second refrigerant stream; (g) further cooling at least a portion of the cooled second refrigerant stream by exchanging heat with the expanded first refrigerant stream to form an additionally cooled, second refrigerant stream; (h) expanding the additionally cooled, second refrigerant stream to form an expanded second refrigerant stream; (i) cooling the liquefied feed gas stream to within a second temperature range by exchanging heat with the expanded second refrigerant stream to form a sub-cooled LNG stream and a first warmed, second refrigerant stream.

In a second embodiment of a method for liquefying a feed gas stream using a first refrigerant stream in a first refrigeration system and a second refrigerant stream in a second refrigeration system, the method also using a first heat exchanger zone and a second heat exchanger zone, the method comprises: (a) providing the feed gas stream at a pressure less than 1,200 psia; (b) providing a compressed first refrigerant stream with a pressure greater than or equal to 1,500 psia and where the compressed first refrigerant stream is the refrigerant of the first refrigeration system; (c)

cooling the compressed first refrigerant stream by indirect heat exchange with an ambient temperature air or water, to produce a cooled first refrigerant stream; (d) directing the cooled first refrigerant stream to the second heat exchanger zone to additionally cool the cooled first refrigerant stream below ambient temperature to produce an additionally cooled first refrigerant stream; (e) expanding the additionally cooled first refrigerant stream in at least one work producing expander, thereby producing an expanded first refrigerant stream; (f) cooling the feed gas stream within the first heat exchanger zone by exchanging heat only with the expanded first refrigerant stream to form a liquefied feed gas stream with a temperature within a first temperature range and a first warmed, first refrigerant stream, whereby the first warmed, first refrigerant stream has a temperature that is cooler by at least 2° C. the highest fluid temperature within the first heat exchanger zone and whereby the heat exchanger type of the first heat exchanger zone is different from the heat exchanger type of the second heat exchanger zone; (g) directing the first warmed, first refrigerant stream to the second heat exchanger zone to cool by indirect heat exchange the cooled first refrigerant stream thereby forming a second warmed, first refrigerant stream; (h) providing a compressed second refrigerant stream, which is the refrigerant of the second refrigeration system, and cooling the compressed second refrigerant stream by indirect heat exchange with an ambient temperature air or water to produce a cooled second refrigerant stream; (i) further cooling at least a portion of the cooled second refrigerant stream within the first heat exchanger zone by exchanging heat with the expanded first refrigerant stream to form an additionally cooled, second refrigerant stream; (j) expanding the additionally cooled, second refrigerant stream to form an expanded second refrigerant stream; (k) cooling the liquefied feed gas stream within the first heat exchanger zone by exchanging heat with the expanded second refrigerant stream to form a sub-cooled LNG stream with a temperature within a second temperature range and a first warmed, second refrigerant stream.

In a third embodiment of a method for liquefying a feed gas stream using a first refrigerant stream in a first refrigeration system and a second refrigerant stream in a second refrigeration stream, the method comprises: (a) providing the feed gas stream at a pressure less than 1,200 psia; (b) providing a compressed first refrigerant stream with a pressure greater than or equal to 1,500 psia and where the compressed first refrigerant stream is the refrigerant of the first refrigeration system; (c) cooling the compressed first refrigerant stream by indirect heat exchange with an ambient temperature air or water to produce a cooled first refrigerant stream; (d) expanding the cooled first refrigerant stream in at least one work producing expander, thereby producing an expanded first refrigerant stream; (e) separating the expanded first refrigerant stream into a first expanded, first refrigerant stream and a second expanded, first refrigerant stream; (f) cooling the feed gas stream to within a first temperature range by exchanging heat with the first expanded, first refrigerant stream to form a liquefied feed gas stream and where the first expanded, first refrigerant stream only exchanges heat with the feed gas stream to form a first warmed, first refrigerant stream; (g) providing a compressed second refrigerant stream, which is the refrigerant of the second refrigeration system, and cooling the compressed second refrigerant stream by indirect heat exchange with an ambient temperature air or water to produce a cooled second refrigerant stream; (h) further cooling at least a portion of the cooled second refrigerant stream by exchanging heat with the second expanded, first refrigerant stream to form an additionally cooled, second refrigerant stream and a second warmed, first refrigerant stream; (i) expanding the additionally cooled, second refrigerant stream to form an expanded second refrigerant stream; (j) cooling the liquefied feed gas stream to within a second temperature range by exchanging heat with the expanded second refrigerant stream to form a sub-cooled LNG stream and a first warmed, second refrigerant stream.

In a fourth embodiment of a method for liquefying a feed gas stream using a first refrigerant stream in a first refrigeration system and a second refrigerant stream in a second refrigeration system, the method also using a first heat exchanger zone and a second heat exchanger zone, the method comprises: (a) providing the feed gas stream at a pressure less than 1,200 psia; (b) providing a compressed first refrigerant stream with a pressure greater than or equal to 1,500 psia, and where the compressed first refrigerant stream is the refrigerant of the first refrigeration system; (c) cooling the compressed first refrigerant stream by indirect heat exchange with an ambient temperature air or water to produce a cooled first refrigerant stream; (d) directing the cooled first refrigerant stream to the second heat exchanger zone to additionally cool the cooled first refrigerant stream below ambient temperature to produce an additionally cooled, first refrigerant stream; (e) expanding the additionally cooled, first refrigerant stream in at least one work producing expander, thereby producing an expanded first refrigerant stream; (f) separating the expanded first refrigerant stream into a first expanded, first refrigerant stream and a second expanded, first refrigerant stream; (g) cooling the feed gas stream within the first heat exchanger zone by exchanging heat with the first expanded, first refrigerant stream to form a liquefied feed gas stream with a temperature within a first temperature range and a first warmed, first refrigerant stream, whereby the first warmed, first refrigerant stream only exchanges heat with the feed gas stream and has a temperature that is cooler by at least 2° C. the highest fluid temperature within the first heat exchanger zone, and whereby the heat exchanger type of the first heat exchanger zone is different from the heat exchanger type of the second heat exchanger zone; (h) combining the first warmed, first refrigerant stream and a second warmed, second refrigerant stream to produce a third warmed, first refrigerant stream. (i) directing the third warmed, first refrigerant stream to the second heat exchanger zone to cool by indirect heat exchange the cooled first refrigerant stream thereby forming a fourth warmed, first refrigerant stream; (j) providing a compressed second refrigerant stream, which is the refrigerant of the second refrigeration system and cooling the compressed second refrigerant stream by indirect heat exchange with an ambient temperature air or water to produce a cooled second refrigerant stream; (k) further cooling at least a portion of the cooled second refrigerant stream within the first heat exchanger zone by exchanging heat with the second expanded, first refrigerant stream to form an additionally cooled, second refrigerant stream and the second warmed, second refrigerant stream; (1) expanding the additionally cooled, second refrigerant stream to form an expanded second refrigerant stream; (m) cooling the liquefied feed gas stream within the first heat exchanger zone by exchanging heat with the expanded second refrigerant stream to form a sub-cooled LNG stream with a temperature within a second temperature range and a first warmed, second refrigerant stream.

In a fifth embodiment of a method for liquefying a feed gas stream using a first refrigerant stream of a first refrigeration system and second refrigerant stream of a second refrigeration system, the method comprising: (a) providing the feed gas stream at a pressure less than 1,200 psia; (b) providing a compressed first refrigerant stream with a pressure greater than or equal to 1,500 psia and where the compressed first refrigerant stream is the refrigerant of the first refrigeration system; (c) cooling the compressed first refrigerant stream by indirect heat exchange with an ambient temperature air or water to produce a cooled first refrigerant stream; (d) expanding the cooled first refrigerant stream in at least one work producing expander, thereby producing an expanded first refrigerant stream; (e) cooling the feed gas stream to within a first temperature range by exchanging heat only with the expanded first refrigerant stream to form a liquefied feed gas stream and a warmed first refrigerant stream; (f) providing a compressed second refrigerant stream, which is the refrigerant of the second refrigeration system, and cooling the compressed second refrigerant stream by indirect heat exchange with an ambient temperature air or water, to produce a cooled second refrigerant stream; (g) further cooling the cooled second refrigerant stream by exchanging heat with a first warmed, second refrigerant stream and then separating the further cooled second refrigerant stream into a first cooled, second refrigerant stream and second cooled, second refrigerant stream; (h) further cooling the first cooled, second refrigerant stream by continuing to exchange heat with the first warmed, second refrigerant stream to produce a first additionally cooled, second refrigerant stream; (i) further cooling the second cooled, second refrigerant stream by exchanging heat with the expanded first refrigerant stream to produce a second additionally cooled, second refrigerant stream; (j) combining the first additionally cooled, second refrigerant stream and the second additionally cooled, second refrigerant stream and then expanding the combined streams to form an expanded second refrigerant stream; (k) cooling the liquefied feed gas stream to within a second temperature range by exchanging heat with the expanded second refrigerant stream to form a sub-cooled LNG stream and the first warmed, second refrigerant stream.

In a sixth embodiment of a method for liquefying a feed gas stream using a first refrigerant stream of a first refrigeration system and a second refrigerant stream of a second refrigeration system, the method also using a first heat exchanger zone and a second heat exchanger zone, the method comprising: (a) providing the feed gas stream at a pressure less than 1,200 psia; (b) providing a compressed first refrigerant stream with a pressure greater than or equal to 1,500 psia and where the compressed first refrigerant stream is the refrigerant of the first refrigeration system; (c) cooling the compressed first refrigerant stream by indirect heat exchange with an ambient temperature air or water to produce a cooled first refrigerant stream; (d) directing the cooled first refrigerant stream to the second heat exchanger zone to additionally cool the cooled first refrigerant stream below ambient temperature to produce an additionally cooled, first refrigerant stream; (e) expanding the additionally cooled, first refrigerant stream in at least one work producing expander, thereby producing an expanded first refrigerant stream; (f) cooling the feed gas stream within a first heat exchanger zone by exchanging heat only with the expanded first refrigerant stream to form a liquefied feed gas stream with a temperature within a first temperature range and a first warmed, first refrigerant stream, whereby the first warmed, first refrigerant stream has a temperature that is cooler by at least 2° C. the highest fluid temperature within the first heat exchanger zone and whereby the heat exchanger type of the first heat exchanger zone is different from the heat exchanger type of the second heat exchanger zone; (g) directing the first warmed, first refrigerant stream to the second heat exchanger zone to cool by indirect heat exchange the cooled first refrigerant stream thereby forming a second warmed, first refrigerant stream; (h) providing a compressed second refrigerant stream, which is the refrigerant of the second refrigeration system, and cooling the compressed second refrigerant stream by indirect heat exchange with an ambient temperature air or water to produce a cooled second refrigerant stream; (i) further cooling the cooled second refrigerant stream by exchanging heat within the first heat exchanger zone with a first warmed, second refrigerant stream and then separating the further cooled second refrigerant stream into a first cooled, second refrigerant stream and second cooled, second refrigerant stream; (j) further cooling the first cooled, second refrigerant stream within the first heat exchanger zone by continuing to exchange heat with the first warmed, second refrigerant stream to produce a first additionally cooled, second refrigerant stream; (i) further cooling the second cooled, second refrigerant stream within the first heat exchanger zone by exchanging heat with the expanded first refrigerant stream to produce a second additionally cooled, second refrigerant stream; (j) combining the first additionally cooled, second refrigerant stream and the second additionally cooled, second refrigerant stream and then expanding the combined streams to form an expanded second refrigerant stream; (k) cooling the liquefied feed gas stream within the first heat exchanger zone by exchanging heat with the expanded second refrigerant stream to form a sub-cooled LNG stream with a temperature within a second temperature range and the first warmed, second refrigerant stream.

Figure 2:
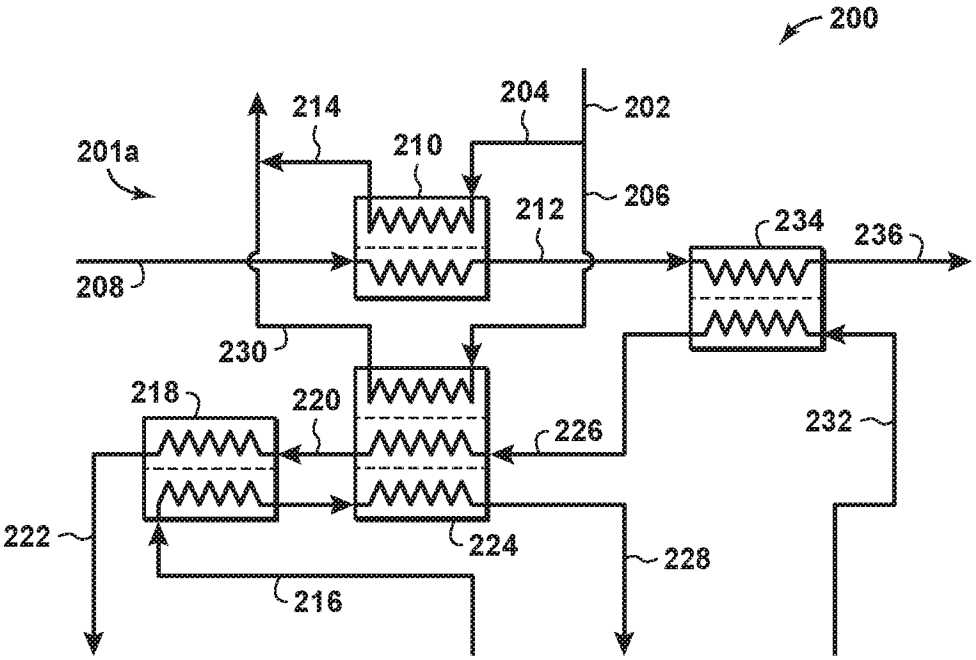
FIG. 2 is a schematic diagram of a system for LNG production according to disclosed aspects.

FIG. 2 illustrates a system 200 for heat transfer in an LNG liquefaction process, and preferably a high pressure expansion process (HPXP), according to disclosed aspects. System 200 may be used to cool and liquefy to a feed gas stream rich in methane. System 200 may be a preferred method for heat transfer, and is particularly suitable when using brazed aluminum type heat exchangers. The illustrated heat exchangers may be designed to be within a single brazed aluminum heat exchanger core. Alternatively, each illustrated heat exchanger may be placed within its own brazed aluminum heat exchanger core. System 200 includes first and second refrigerant systems 201*a*, 201*b*. First refrigerant system 201*a* uses a first refrigerant that preferably comprises methane, and in a preferred aspect comprises more 70 mol % methane, or more than 80 mol % methane, or more than 85 mol % methane, or more than 90 mol % methane. Second refrigerant system 201*b* uses a second refrigerant that preferably comprises nitrogen, and in a preferred aspect comprises more 70 mol % nitrogen, or more than 80 mol % nitrogen, or more than 85 mol % nitrogen, or more than 90 mol % nitrogen, or more than 95 mol % nitrogen. In the illustrated heat transfer method, an expanded first refrigerant stream 202, comprising the first refrigerant, is separated into a first expanded, first refrigerant stream 204 and a second expanded, first refrigerant stream 206. The feed gas stream 208 is cooled within a first heat exchanger 210 to a first temperature range by exchanging heat with the first expanded, first refrigerant stream 204 resulting in the formation of a liquefied feed gas stream 212 and a first warmed, first refrigerant stream 214. A cooled second refrigerant stream 216, comprising the second refrigerant, is first cooled within a second heat exchanger 218 by exchanging heat with a second warmed, second refrigerant stream 220 to form a third warmed, second refrigerant stream 222. The cooled second refrigerant stream 216 is then further cooled within a third heat exchanger 224 by exchanging heat with the second expanded, first refrigerant stream 206 and a first warmed, second refrigerant stream 226 resulting in the formation of an additionally cooled, second refrigerant stream 228, the second warmed, second refrigerant stream 220, and a second warmed, first refrigerant stream 230. The additionally cooled, second refrigerant stream 228 is near isentropically expanded in an expander (not shown) to produce an expanded second refrigerant stream 232. The liquefied feed gas stream 212 is cooled within a fourth heat exchanger 234 to a second temperature range by exchanging heat with the expanded second refrigerant stream 232 resulting in the formation of a sub-cooled LNG stream 236 and the first warmed, second refrigerant stream 226.

Figure 3:
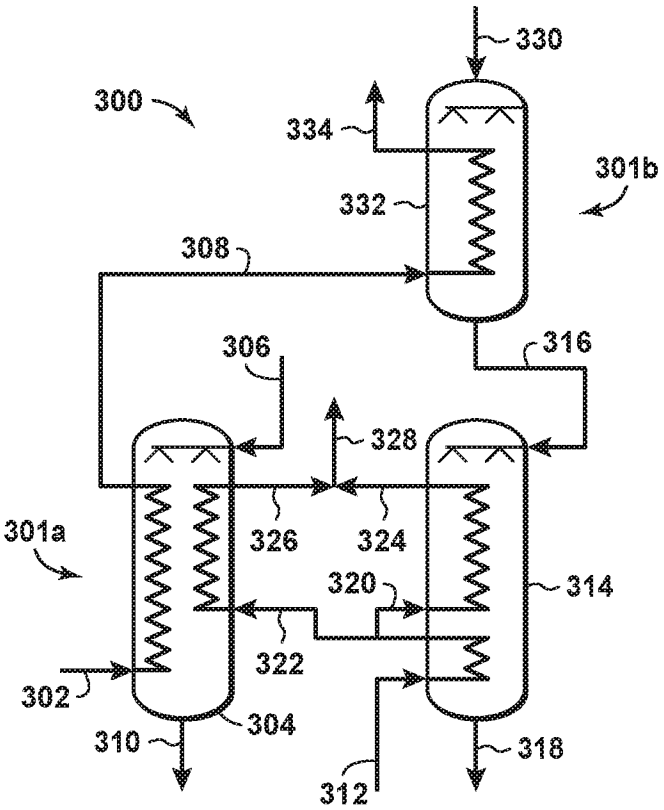
FIG. 3 is a schematic diagram of a system for LNG production according to disclosed aspects.

FIG. 3 illustrates a system 300 for heat transfer in an LNG liquefaction process, and preferably a high pressure expansion process (HPXP), according to disclosed aspects. System 300 may be used to cool and liquefy to a feed gas stream rich in methane. System 300 may be a preferred method for heat transfer, and is particularly suitable for spiral wound type heat exchangers. System 300 includes first and second refrigerant systems 301*a*, 301*b*. First refrigerant system 301*a* uses a first refrigerant that preferably comprises methane, and in a preferred aspect comprises more 70 mol % methane, or more than 80 mol % methane, or more than 85 mol % methane, or more than 90 mol % methane. Second refrigerant system 301*b* uses a second refrigerant that preferably comprises nitrogen, and in a preferred aspect comprises more 70 mol % nitrogen, or more than 80 mol % nitrogen, or more than 85 mol % nitrogen, or more than 90 mol % nitrogen, or more than 95 mol % nitrogen. A feed gas stream 302, which may be a methane-rich feed gas stream, is cooled within a first heat exchanger 304 to a first temperature range by exchanging heat with an expanded first refrigerant stream 306, comprising the first refrigerant, resulting in the formation of a liquefied feed gas stream 308 and a warmed first refrigerant stream 310. A cooled second refrigerant stream 312, comprising the second refrigerant, is first cooled within a second heat exchanger 314 by exchanging heat with a first warmed, second refrigerant stream 316 to form a second warmed, second refrigerant stream 318. The cooled second refrigerant stream 312 is then separated into a first cooled, second refrigerant stream 320 and a second cooled, second refrigerant stream 322. The first cooled, second refrigerant stream 320 is further cooled within the second heat exchanger 314 by continuing to exchange heat with the first warmed, second refrigerant stream 316 to form a first additionally cooled, second refrigerant stream 324. The second cooled, second refrigerant stream 322 is further cooled within the first heat exchanger 304 by exchanging heat with the expanded first refrigerant stream 306 to form a second additionally cooled, second refrigerant stream 326. The first additionally cooled, second refrigerant stream 324 is combined with the second additionally cooled, second refrigerant stream 326 to form an additionally cooled, second refrigerant stream 328. The additionally cooled, second refrigerant stream 328 is then near isentropically expanded in an expander (not shown) to produce an expanded second refrigerant stream 330. The liquefied feed gas stream 308 is cooled within a third heat exchanger 332 to a second temperature range by exchanging heat with the expanded second refrigerant stream 330 resulting in the formation of a sub-cooled LNG stream 334 and the first warmed, second refrigerant stream 316. The first heat exchanger 304, the second heat exchanger 314 and the third heat exchanger 332 may be separate spiral wound heat exchangers. The second heat exchanger 314 and the third heat exchanger 332 may be the same spiral wound exchanger of two or more cold bundles.

Figure 4:
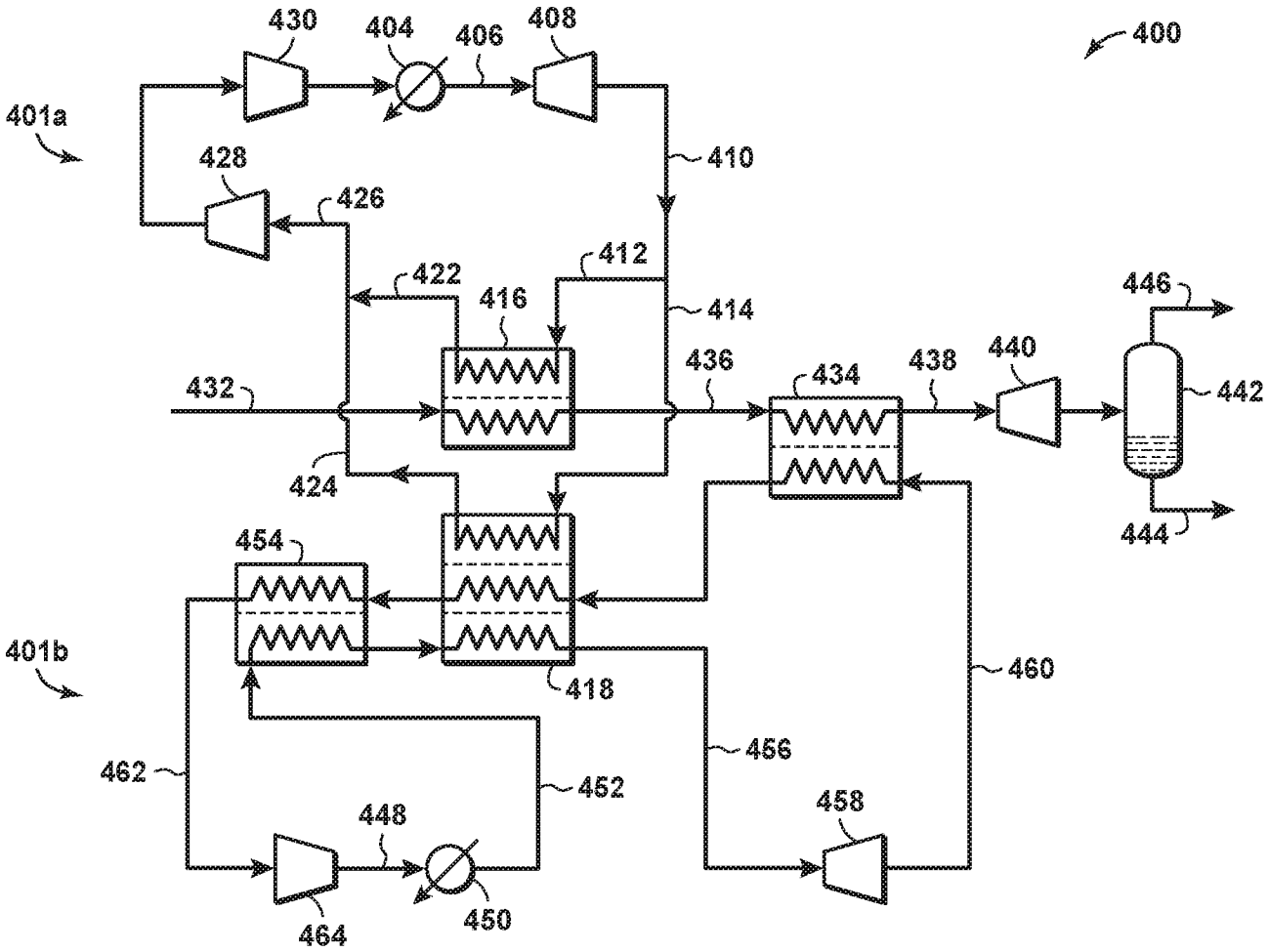
FIG. 4 is a schematic diagram of a system for LNG production according to disclosed aspects.

FIG. 4 illustrates a system 400 for heat transfer in an LNG liquefaction process, and preferably a high pressure expansion process HPXP, according to disclosed aspects. System 400 may be used to cool and liquefy to a feed gas stream rich in methane. FIG. 4 depicts in more detail how the system 200 may be incorporated into an LNG liquefaction process. The names of some of the components and streams in FIG. 2 are used here for consistency. System 400 includes first and second refrigerant systems 401*a*, 401*b*. First refrigerant system 401*a* uses a first refrigerant that preferably comprises methane, and in a preferred aspect comprises more 70 mol % methane, or more than 80 mol % methane, or more than 85 mol % methane, or more than 90 mol % methane. Second refrigerant system 401*b* uses a second refrigerant that preferably comprises nitrogen, and in a preferred aspect comprises more 70 mol % nitrogen, or more than 80 mol % nitrogen, or more than 85 mol % nitrogen, or more than 90 mol % nitrogen, or more than 95 mol % nitrogen. A compressed first refrigerant stream 402, comprising the first refrigerant, with a pressure greater than or equal to 1,500 psia is cooled by indirect heat exchange with an ambient temperature air or water in a cooler 404 to produce a cooled first refrigerant stream 406. The cooled first refrigerant stream 406 is near-isentropically expanded in at least one work producing expander 408 to produce an expanded first refrigerant stream 410. The expanded first refrigerant stream 410 is separated into a first expanded, first refrigerant stream 412 and a second expanded, first refrigerant stream 414. The first expanded, first refrigerant stream 412 and the second expanded, second refrigerant stream 414 are warmed within heat exchangers 416, 418, respectively, which are configured in the fashion described in FIG. 2, to produce a first warmed, first refrigerant stream 422 and a second warmed, first refrigerant stream 424. The first warmed, first refrigerant stream 422 is combined with the second warmed, first refrigerant stream 424 to produce a warmed first refrigerant stream 426. The warmed first refrigerant stream 426 is compressed in one or more compressors 428, 430 to produce the compressed first refrigerant stream 402. A feed gas stream 432 is cooled with heat exchangers 416, 434, which are configured in the fashion described in FIG. 2. Heat exchanger 416 cools the feed gas stream 432 to produce a liquefied feed gas stream 436 with a temperature within a first temperature range. The heat exchanger 434 further cools the liquefied feed gas stream 436 to produce a sub-cooled LNG stream 438 with a temperature within a second temperature range. The sub-cooled LNG stream 438 is expanded in an expander 440 and then directed to a separation tank 442, where an LNG stream 444 is withdrawn and remaining gaseous vapors are withdrawn as a flash gas stream 446. A compressed second refrigerant stream 448, which comprises the second refrigerant, is cooled by indirect heat exchange with an ambient temperature air or water in a cooler 450 to produce a cooled second refrigerant stream 452. The cooled second refrigerant stream 452 is further cooled within heat exchangers 454, 418, each of which being configured in the fashion described in FIG. 2, to produce an additionally cooled, second refrigerant stream 456. The additionally cooled, second refrigerant stream 456 is expanded in a work producing expander 458 to produce an expanded second refrigerant stream 460. The expanded second refrigerant stream 460 is warmed within heat exchangers 434, 418, and 454, configured in the fashion described in FIG. 2, to produce a third warmed, second refrigerant stream 462. The third warmed, second refrigerant stream 462 is compressed in one or more compressors 464 to produce the compressed second refrigerant stream 448.

Figure 5:
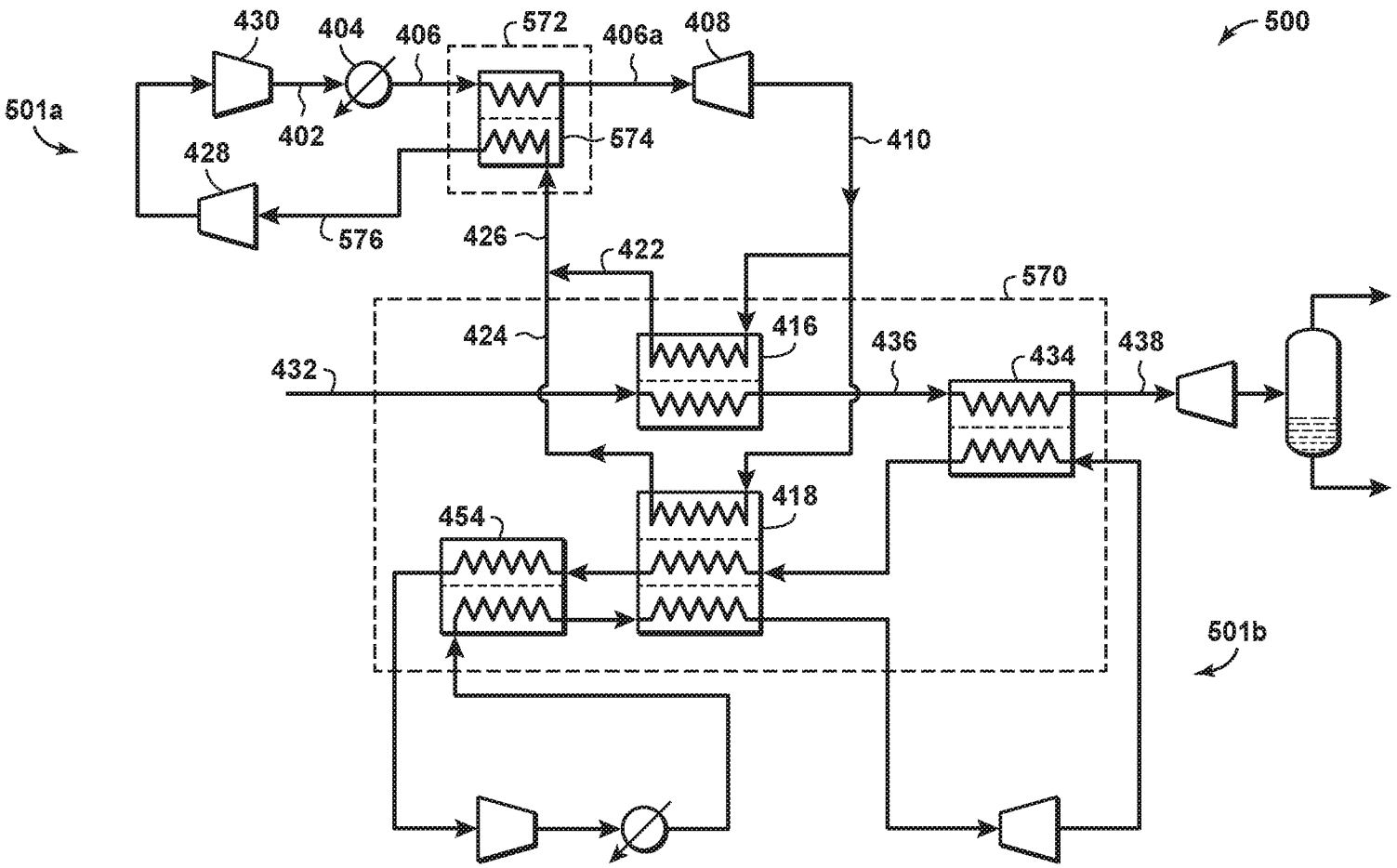
FIG. 5 is a schematic diagram of a system for LNG production according to disclosed aspects.

FIG. 5 illustrates a system 500 for heat transfer in an LNG liquefaction process according to another aspect of the disclosure. System 500 is similar to system 400, and for the sake of brevity similarly depicted components and streams may not be further described. System 500 defines first and second heat exchanger zones 570, 572. First heat exchanger zone 570 includes heat exchangers 416, 418, 434, and 454 as previously described. Second heat exchanger zone 572 includes one or more heat exchangers 574. System 500 includes first and second refrigerant systems 501*a*, 501*b*. First refrigerant system 501*a* uses a first refrigerant that preferably comprises methane, and in a preferred aspect comprises more 70 mol % methane, or more than 80 mol % methane, or more than 85 mol % methane, or more than 90 mol % methane. Second refrigerant system 501*b* uses a second refrigerant that preferably comprises nitrogen, and in a preferred aspect comprises more 70 mol % nitrogen, or more than 80 mol % nitrogen, or more than 85 mol % nitrogen, or more than 90 mol % nitrogen, or more than 95 mol % nitrogen. A compressed first refrigerant stream 402, comprising the first refrigerant, with a pressure greater than or equal to 1,500 psia is cooled by indirect heat exchange with an ambient temperature air or water in a cooler 404 to produce a cooled first refrigerant stream 406. The cooled first refrigerant stream 406 is directed to the second heat exchanger zone 572 to additionally cool the cool first refrigerant stream 406 below ambient temperature, thereby producing an additionally cooled, first refrigerant stream 406*a*. The additionally cooled, first refrigerant stream 406*a* is expanded in at least one work producing expander in order to produce an expanded first refrigerant stream 410. The expanded first refrigerant stream 410 is directed to the heat exchangers 416, 418 as previously described. The third warmed refrigerant stream 426, which is a combination of the first and second warmed refrigerant streams 422, 424, is directed to the second heat exchanger zone 572 to cool by indirect heat exchange, in one or more heat exchangers 574, the cooled first refrigerant stream 406, thereby forming a fourth warmed, first refrigerant stream 576. The fourth warmed, first refrigerant stream 576 is compressed in one or more compressors 428, 430 to produce the compressed first refrigerant stream 402. A feed gas stream 432 is directed to the first heat exchanger zone 570 where the heat exchangers are configured in the fashion described in FIGS. 2 and 4. The feed gas stream 432 is cooled within the first heat exchanger zone 570 to first produce a liquefied feed gas 436 with a temperature within a first temperature range and then further cooled, in the second refrigeration system 501*b*, to produce a sub-cooled LNG stream 438 with a temperature within a second temperature range. The sub-cooled LNG stream 438 is further processed as previously disclosed with respect to FIGS. 2 and 4.

Figure 6:
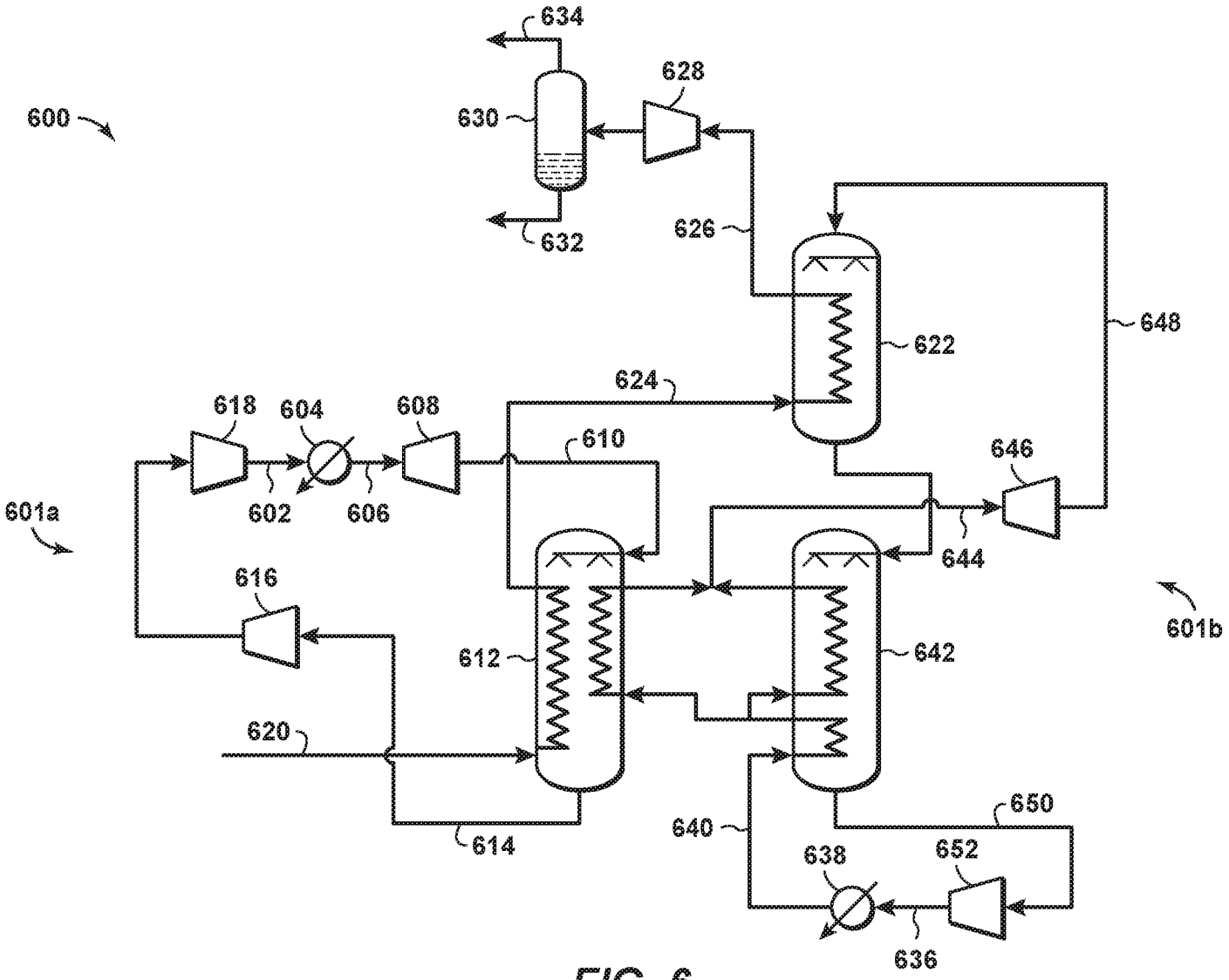
FIG. 6 is a schematic diagram of a system for LNG production according to disclosed aspects.

FIG. 6 illustrates a system 600 for heat transfer in an LNG liquefaction process, and preferably a high pressure expansion process HPXP, according to disclosed aspects. System 600 may be used to cool and liquefy to a feed gas stream rich in methane. FIG. 6 depicts in more detail how the system 300 may be incorporated into an LNG liquefaction process. The names of some of the components and streams in FIG. 3 are used here for consistency. System 600 includes first and second refrigerant systems 601*a*, 601*b*. First refrigerant system 601*a* uses a first refrigerant that preferably comprises methane, and in a preferred aspect comprises more 70 mol % methane, or more than 80 mol % methane, or more than 85 mol % methane, or more than 90 mol % methane. Second refrigerant system 601*b* uses a second refrigerant that preferably comprises nitrogen, and in a preferred aspect comprises more 70 mol % nitrogen, or more than 80 mol % nitrogen, or more than 85 mol % nitrogen, or more than 90 mol % nitrogen, or more than 95 mol % nitrogen. A compressed first refrigerant stream 602, comprising the first refrigerant, with a pressure greater than or equal to 1,500 psia is cooled by indirect heat exchange with an ambient temperature air or water in a cooler 604 to produce a cooled first refrigerant stream 606. The cooled first refrigerant stream 606 is expanded in at least one work producing expander 608 to produce an expanded first refrigerant stream 610. The expanded first refrigerant stream 610 is warmed within heat exchanger 612, configured in the fashion described in FIG. 3 with respect to heat exchanger 304, to produce a warmed first refrigerant stream 614. The warmed first refrigerant stream 614 is compressed in one or more compressors 616, 618 to produce the compressed first refrigerant stream 602. A feed gas stream 620 is cooled with heat exchangers 612, 622 configured in the fashion described in FIG. 3 with respect to heat exchangers 304, 332, respectively, to first produce a liquefied feed gas stream 624 with a temperature within a first temperature range and then further cooled in the second refrigeration system 602*b* to produce a sub-cooled LNG stream 626 with a temperature within a second temperature range. The sub-cooled LNG stream 626 is expanded in an expander 628 and then directed to a separation tank 630. An LNG stream 632 is withdrawn from the separation tank 630. A gaseous vapor stream 634 may also be withdrawn from the separation tank 630. A compressed second refrigerant stream 636, comprising the second refrigerant, is cooled by indirect heat exchange with an ambient temperature air or water in a cooler 638 to produce a cooled second refrigerant stream 640. The cooled second refrigerant stream 640 is further cooled within heat exchangers 642, 612 configured in the fashion described in FIG. 3 with respect to heat exchangers 314, 304, respectively, to produce an additionally cooled, second refrigerant stream 644. The additionally cooled, second refrigerant stream is expanded in a work producing expander 646 to produce an expanded second refrigerant stream 648. The expanded second refrigerant stream 648 is warmed within heat exchangers 622, 642, configured in the fashion described in FIG. 3 with respect to heat exchangers 332, 314, respectively, to produce a second warmed, second refrigerant stream 650. The second warmed, second refrigerant stream 650 is compressed in one or more compressors 652 to produce the compressed second refrigerant stream 636.

Figure 7:
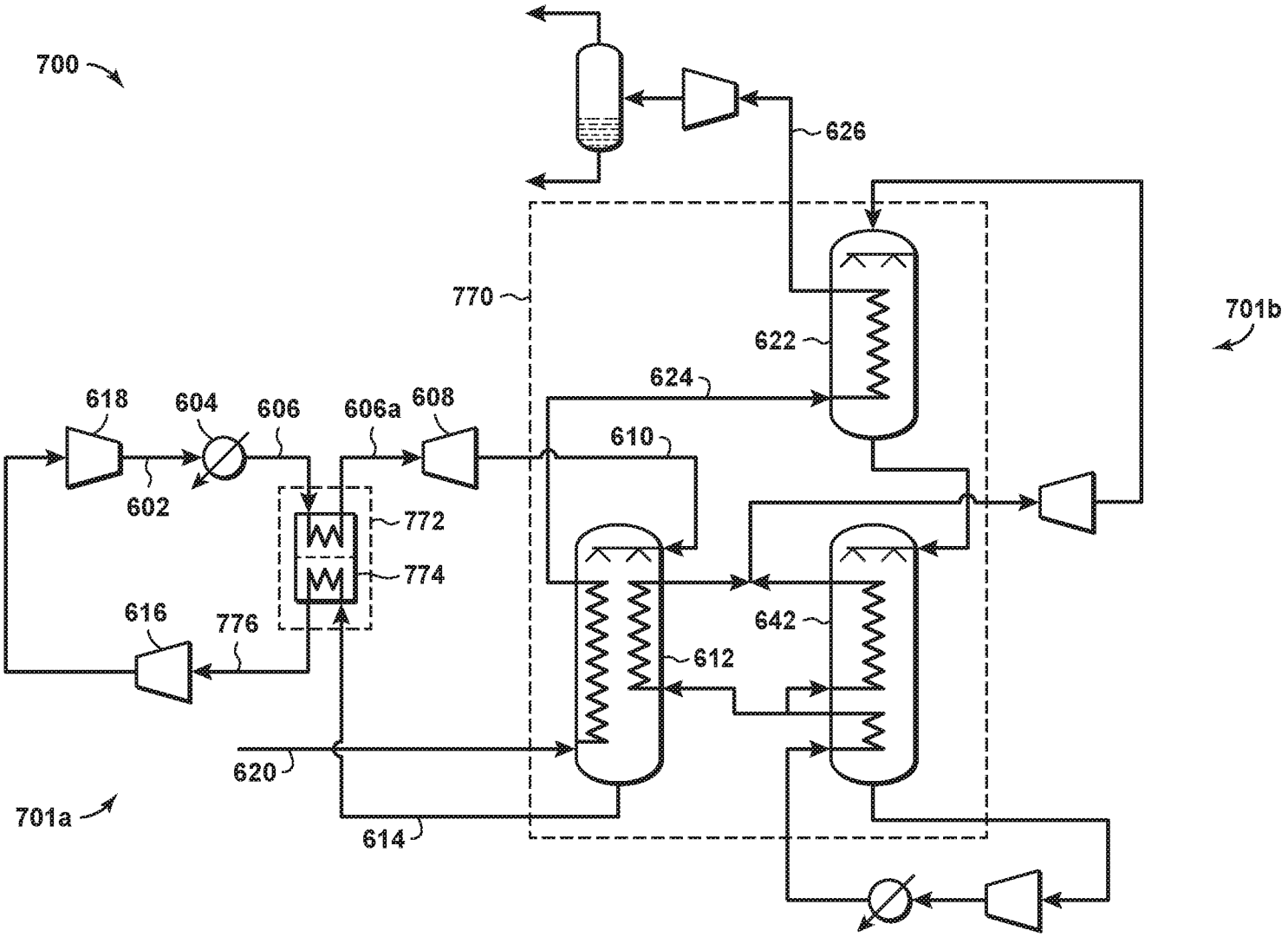
FIG. 7 is a schematic diagram of a system for LNG production according to disclosed aspects.

FIG. 7 illustrates a system 700 for heat transfer in an LNG liquefaction process according to another aspect of the disclosure. System 700 is similar to system 600, and for the sake of brevity similarly depicted components and streams may not be further described. System 700 defines first and second heat exchanger zones 770, 772. First heat exchanger zone 770 includes heat exchangers 612, 622, and 642 as previously described with respect to FIGS. 6 and 3. Second heat exchanger zone 772 includes one or more heat exchangers 774. System 700 includes first and second refrigerant systems 701*a*, 701*b*. First refrigerant system 701*a* uses a first refrigerant that preferably comprises methane, and in a preferred aspect comprises more 70 mol % methane, or more than 80 mol % methane, or more than 85 mol % methane, or more than 90 mol % methane. Second refrigerant system 701*b* uses a second refrigerant that preferably comprises nitrogen, and in a preferred aspect comprises more 70 mol % nitrogen, or more than 80 mol % nitrogen, or more than 85 mol % nitrogen, or more than 90 mol % nitrogen, or more than 95 mol % nitrogen. A compressed first refrigerant stream 602, comprising the first refrigerant, with a pressure greater than or equal to 1,500 psia is cooled by indirect heat exchange with an ambient temperature air or water in a cooler 604 to produce a cooled first refrigerant stream 606. The cooled first refrigerant stream 606 is directed to the second heat exchanger zone 772 to additionally cool, in the one or more heat exchangers 774, the cooled first refrigerant stream 606 below ambient temperature to produce an additionally cooled first refrigerant stream 606*a*. The additionally cooled first refrigerant stream 606*a* is expanded in at least one work producing expander 608 to produce an expanded first refrigerant stream 610. The expanded first refrigerant stream 610 is directed to the first heat exchanger zone 770 where it is warmed within the first heat exchanger 612 to produce a first warmed, first refrigerant stream 614. The first warmed, first refrigerant stream 614 is directed to the second heat exchanger zone 772 to cool by indirect heat exchange in the one or more heat exchangers 774 the cooled first refrigerant stream 606, thereby forming a second warmed, first refrigerant stream 776. The second warmed, first refrigerant stream 776 is compressed in one or more compressors 616, 618 to produce the compressed first refrigerant stream 602. A feed gas stream 620 is directed to the first heat exchanger zone 770 where it is cooled within heat exchanger 612 to first produce a liquefied feed gas stream 624 with a temperature within a first temperature range. The liquefied feed gas stream 624 is further cooled in heat exchanger 622 of the second refrigeration system 701*b* to produce a sub-cooled LNG stream 626 with a temperature within a second temperature range. The sub-cooled LNG stream 626 is further processed as previously disclosed with respect to FIGS. 3 and 6.

In any of the aspects of the disclosure, such as those depicted in FIGS. 3-7, the first refrigeration system may comprise a closed loop gas phase refrigeration cycle, and the second refrigeration system may comprise a closed loop gas phase refrigeration cycle where nitrogen is the refrigerant.

Figure 8:
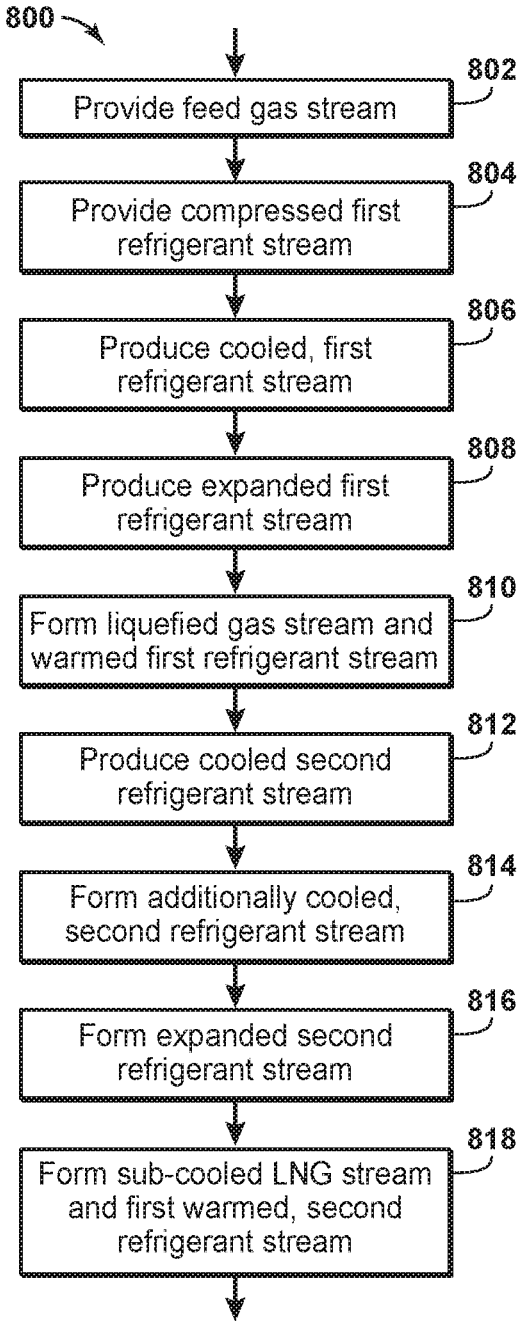
FIG. 8 is a flowchart of a method according to aspects of the disclosure.

FIG. 8 is a flowchart of a method 800 for liquefying a feed gas stream rich in methane using a first refrigeration system having a first refrigerant and a second refrigeration system using a second refrigerant. Method 800 includes the following steps: 802, providing the feed gas stream at a pressure less than 1,200 psia; 804, providing a compressed first refrigerant stream with a pressure greater than or equal to 1,500 psia, wherein the first refrigerant comprises the compressed first refrigerant stream; 806, cooling the compressed first refrigerant stream by indirect heat exchange with an ambient temperature air or water, to produce a cooled first refrigerant stream; 808, expanding the cooled first refrigerant stream in at least one work producing expander, thereby producing an expanded first refrigerant stream; 810, cooling the feed gas stream to within a first temperature range by exchanging heat only with the expanded first refrigerant stream to form a liquefied feed gas stream and a warmed first refrigerant stream; 812, providing a compressed second refrigerant stream, comprising the second refrigerant, and cooling the compressed second refrigerant stream by indirect heat exchange with an ambient temperature air or water, to produce a cooled second refrigerant stream; 814, further cooling at least a portion of the cooled second refrigerant stream by exchanging heat with the expanded first refrigerant stream to form an additionally cooled, second refrigerant stream; 816, expanding the additionally cooled, second refrigerant stream to form an expanded second refrigerant stream; and 818, cooling the liquefied feed gas stream to within a second temperature range by exchanging heat with the expanded second refrigerant stream to form a sub-cooled LNG stream and a first warmed, second refrigerant stream.

Figure 9:
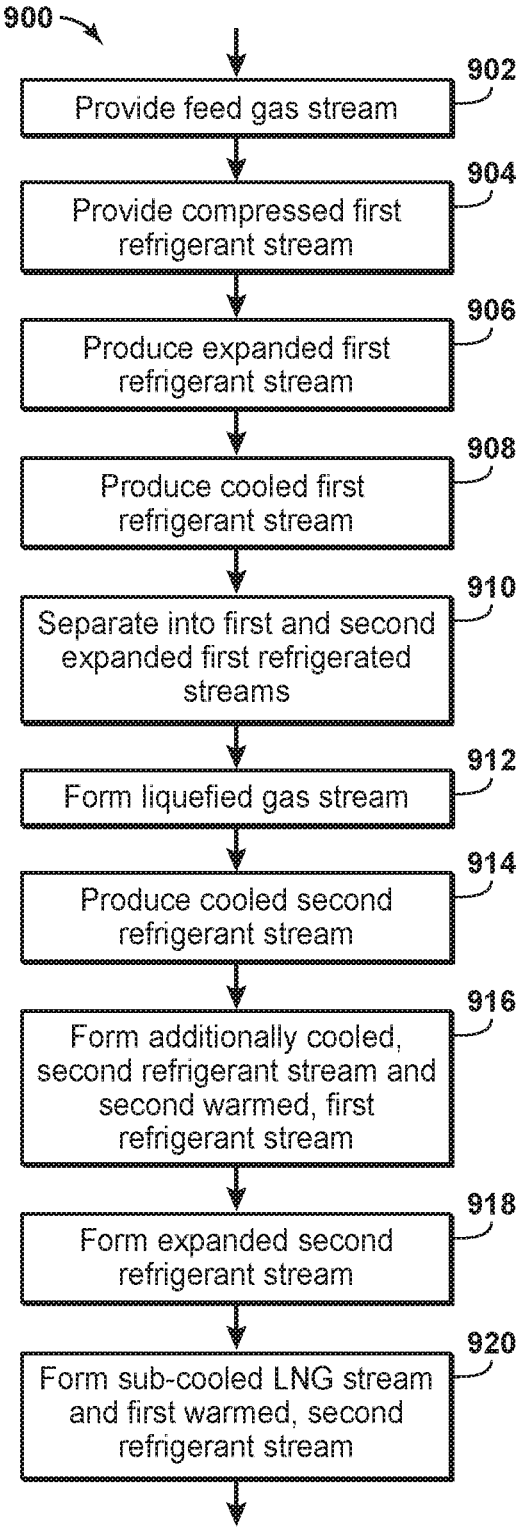
FIG. 9 is a flowchart of a method according to aspects of the disclosure.

FIG. 9 is a flowchart of a method 900 for liquefying a feed gas stream rich in methane using a first refrigeration system having a first refrigerant and a second refrigeration system having a second refrigerant. Method 900 includes the following steps: 902, providing the feed gas stream at a pressure less than 1,200 psia; 904, providing a compressed first refrigerant stream with a pressure greater than or equal to 1,500 psia, wherein the first refrigerant stream comprises the compressed first refrigerant stream; 906, cooling the compressed first refrigerant stream by indirect heat exchange with an ambient temperature air or water, to produce a cooled first refrigerant stream; 908, expanding the cooled first refrigerant stream in at least one work producing expander, thereby producing an expanded first refrigerant stream; 910, separating the expanded first refrigerant stream into a first expanded, first refrigerant stream and a second expanded, first refrigerant stream; 912, cooling the feed gas stream to within a first temperature range by exchanging heat with the first expanded, first refrigerant stream to form a liquefied feed gas stream, wherein the first expanded, first refrigerant stream only exchanges heat with the feed gas stream to form a first warmed, first refrigerant stream; 914, providing a compressed second refrigerant stream, comprising the second refrigerant, and cooling the compressed second refrigerant stream by indirect heat exchange with an ambient temperature air or water, to thereby produce a cooled second refrigerant stream; 916, further cooling at least a portion of the cooled second refrigerant stream by exchanging heat with the second expanded, first refrigerant stream, to thereby form an additionally cooled, second refrigerant stream and a second warmed, first refrigerant stream; 920, expanding the additionally cooled, second refrigerant stream to form an expanded second refrigerant stream; and 922, cooling the liquefied feed gas stream to within a second temperature range by exchanging heat with the expanded second refrigerant stream, to thereby form a sub-cooled LNG stream and a first warmed, second refrigerant stream.

Figure 10:
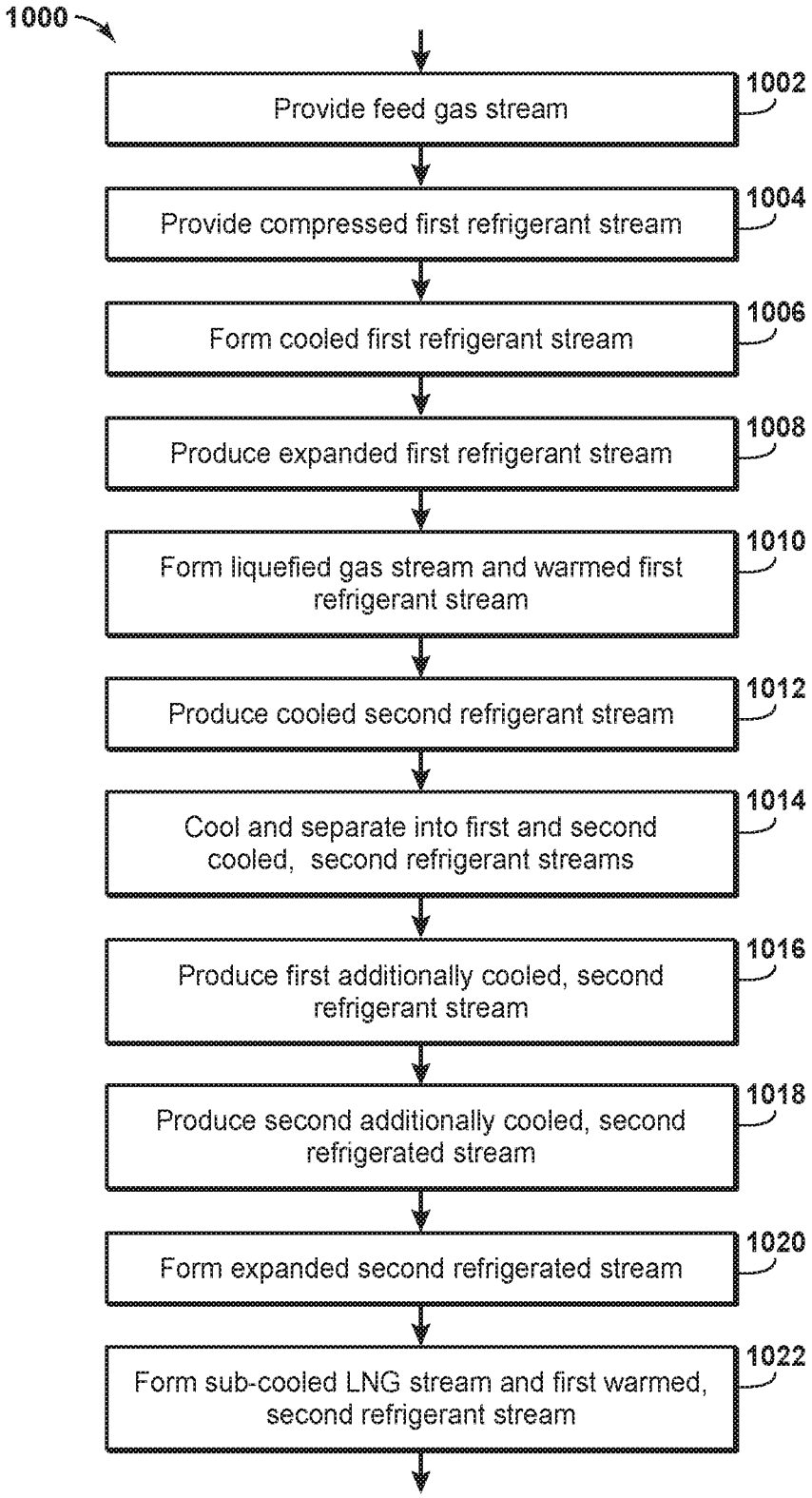
FIG. 10 is a flowchart of a method according to aspects of the disclosure.

FIG. 10 is a flowchart of a method 1000 for liquefying a feed gas stream rich in methane using a first refrigeration system having a first refrigerant and a second refrigeration system using a second refrigerant. Method 1000 includes the following steps: 1002, providing the feed gas stream at a pressure less than 1,200 psia; 1004, providing a compressed first refrigerant stream with a pressure greater than or equal to 1,500 psia, wherein the compressed first refrigerant stream comprises the first refrigerant; 1006, cooling the compressed first refrigerant stream by indirect heat exchange with an ambient temperature air or water, to produce a cooled first refrigerant stream; 1008, expanding the cooled first refrigerant stream in at least one work producing expander, thereby producing an expanded first refrigerant stream; 1010, cooling the feed gas stream to within a first temperature range by exchanging heat only with the expanded first refrigerant stream, to thereby form a liquefied feed gas stream and a warmed first refrigerant stream; 1012, providing a compressed second refrigerant stream, comprising the second refrigerant, and cooling the compressed second refrigerant stream by indirect heat exchange with an ambient temperature air or water, to thereby produce a cooled second refrigerant stream; 1014, further cooling the cooled second refrigerant stream by exchanging heat with a first warmed, second refrigerant stream and then separating the further cooled second refrigerant stream into a first cooled, second refrigerant stream and second cooled, second refrigerant stream; 1016, further cooling the first cooled, second refrigerant stream by continuing to exchange heat with the first warmed, second refrigerant stream, to thereby produce a first additionally cooled, second refrigerant stream; 1018, further cooling the second cooled, second refrigerant stream by exchanging heat with the expanded first refrigerant stream, to thereby produce a second additionally cooled, second refrigerant stream; 1020, combining the first additionally cooled, second refrigerant stream and the second additionally cooled, second refrigerant stream and then expanding the combined streams to thereby form an expanded second refrigerant stream; and 1022, cooling the liquefied feed gas stream to within a second temperature range by exchanging heat with the expanded second refrigerant stream, to thereby form a sub-cooled LNG stream and the first warmed, second refrigerant stream.

Figure 11:
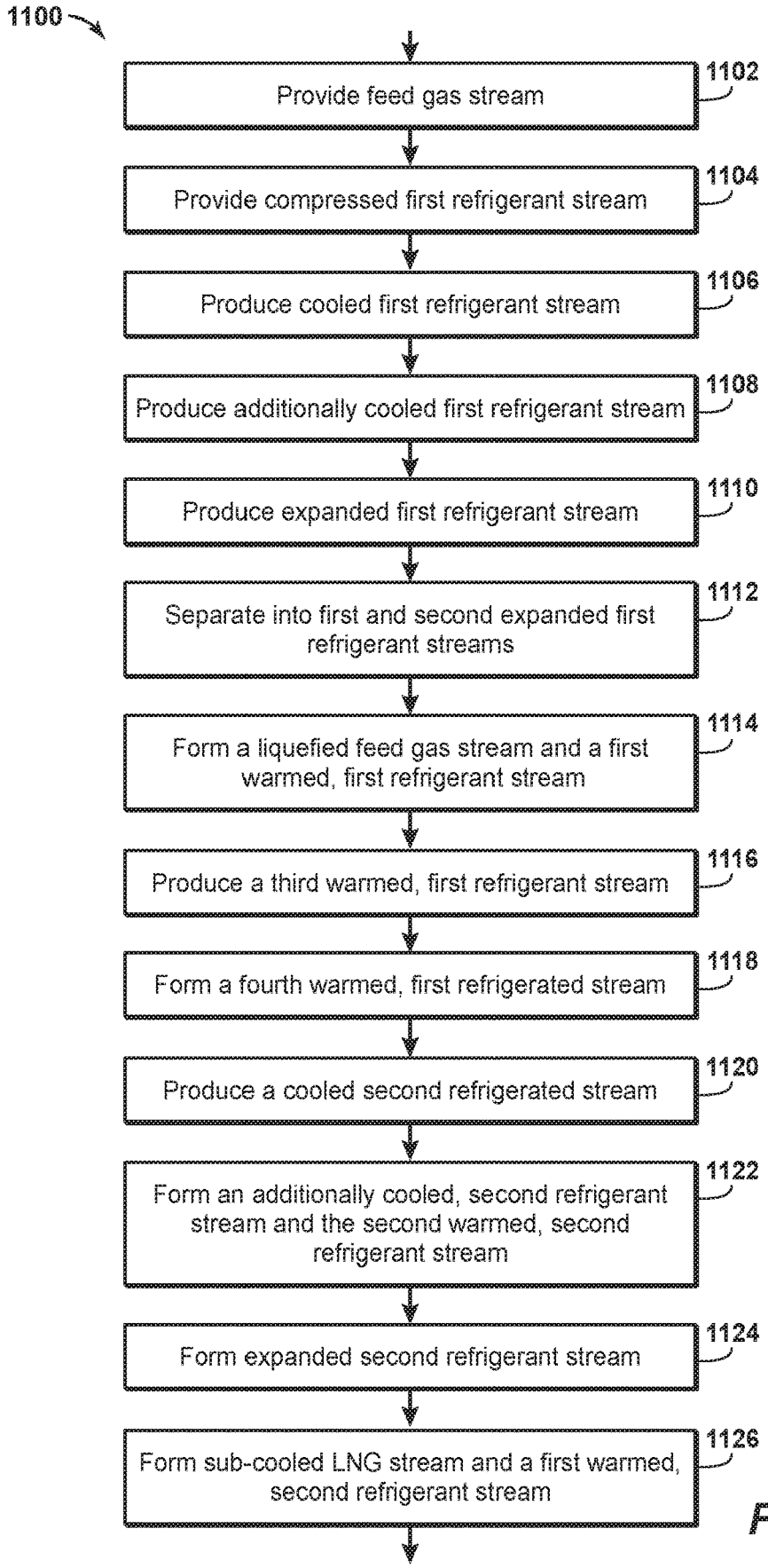
FIG. 11 is a flowchart of a method according to aspects of the disclosure.

FIG. 11 is a flowchart of a method 1100 for liquefying a feed gas stream using a first refrigerant stream in a first refrigeration system and a second refrigerant stream in a second refrigeration system, the method also using a first heat exchanger zone and a second heat exchanger zone. Method 1100 includes the following steps: 1102, providing the feed gas stream at a pressure less than 1,200 psia; 1104, providing a compressed first refrigerant stream with a pressure greater than or equal to 1,500 psia; 1106, cooling the compressed first refrigerant stream by indirect heat exchange with an ambient temperature air or water to produce a cooled first refrigerant stream; 1108, directing the cooled first refrigerant stream to the second heat exchanger zone to additionally cool the cooled first refrigerant stream below ambient temperature to produce an additionally cooled, first refrigerant stream; 1110, expanding the additionally cooled, first refrigerant stream in at least one work producing expander, thereby producing an expanded first refrigerant stream; 1112, separating the expanded first refrigerant stream into a first expanded, first refrigerant stream and a second expanded, first refrigerant stream; 1114, cooling the feed gas stream within the first heat exchanger zone by exchanging heat with the first expanded, first refrigerant stream to form a liquefied feed gas stream with a temperature within a first temperature range and a first warmed, first refrigerant stream, wherein the first warmed, first refrigerant stream only exchanges heat with the feed gas stream and has a temperature that is cooler by at least 2° C. the highest fluid temperature within the first heat exchanger zone, and wherein a heat exchanger type of the first heat exchanger zone is different from a heat exchanger type of the second heat exchanger zone; 1116, combining the first warmed, first refrigerant stream and a second warmed, second refrigerant stream to produce a third warmed, first refrigerant stream; 1118, directing the third warmed, first refrigerant stream to the second heat exchanger zone to cool by indirect heat exchange the cooled first refrigerant stream thereby forming a fourth warmed, first refrigerant stream; 1120, cooling a compressed second refrigerant stream by indirect heat exchange with an ambient temperature air or water to produce a cooled second refrigerant stream; 1122, further cooling at least a portion of the cooled second refrigerant stream within the first heat exchanger zone by exchanging heat with the second expanded, first refrigerant stream to form an additionally cooled, second refrigerant stream and the second warmed, second refrigerant stream; 1124, expanding the additionally cooled, second refrigerant stream to form an expanded second refrigerant stream; and 1126, cooling the liquefied feed gas stream within the first heat exchanger zone by exchanging heat with the expanded second refrigerant stream to form a sub-cooled LNG stream with a temperature within a second temperature range and a first warmed, second refrigerant stream.

The steps depicted in FIGS. 8-11 are provided for illustrative purposes only and a particular step may not be required to perform the disclosed methodology. Moreover, FIGS. 8-11 may not illustrate all the steps that may be performed. The claims, and only the claims, define the disclosed system and methodology.

Aspects of the disclosure have several advantages over the known liquefaction processes. The embodiments described herein allows for better control of the balance of refrigeration between the first refrigeration system and the second refrigeration system for varying gas compositions. For example, a rich feed gas stream compared to a lean feed gas stream requires greater refrigeration in the first temperature range and less refrigerant in the second temperature range. The operator is able to provide the optimized balance of refrigeration for a standardized heat exchanger equipment simply by changing the flow rates and possibly operating temperatures of the first refrigeration system and second refrigeration system The heat exchanger configuration shown in FIG. 2 has the additional benefit allowing one to estimate the temperature of the liquefied feed gas stream without haven to place a temperature measuring device within the brazed aluminum heat exchanger. It is usually not desired to place thermocouples within the brazed aluminum heat exchanger. During steady state operation, the temperature of the liquefied feed gas stream can be estimated by measuring the temperature of the first warmed, first refrigerant stream since the streams only exchange heat with each other.

Aspects of the disclosure may include any combinations of the methods and systems shown in the following numbered paragraphs. This is not to be considered a complete listing of all possible aspects, as any number of variations can be envisioned from the description above.

1. A method for liquefying a feed gas stream rich in methane using a first refrigeration system having a first refrigerant and a second refrigeration system using a second refrigerant, the method comprising:

a. providing the feed gas stream at a pressure less than 1,200 psia;

b. providing a compressed first refrigerant stream with a pressure greater than or equal to 1,500 psia, wherein the first refrigerant comprises the compressed first refrigerant stream;

c. cooling the compressed first refrigerant stream by indirect heat exchange with an ambient temperature air or water, to produce a cooled first refrigerant stream;

d. expanding the cooled first refrigerant stream in at least one work producing expander, thereby producing an expanded first refrigerant stream;

e. cooling the feed gas stream to within a first temperature range by exchanging heat only with the expanded first refrigerant stream to form a liquefied feed gas stream and a warmed first refrigerant stream;

f. providing a compressed second refrigerant stream, comprising the second refrigerant, and cooling the compressed second refrigerant stream by indirect heat exchange with an ambient temperature air or water, to produce a cooled second refrigerant stream;

g. further cooling at least a portion of the cooled second refrigerant stream by exchanging heat with the expanded first refrigerant stream to form an additionally cooled, second refrigerant stream;

h. expanding the additionally cooled, second refrigerant stream to form an expanded second refrigerant stream; and i. cooling the liquefied feed gas stream to within a second temperature range by exchanging heat with the expanded second refrigerant stream to form a sub-cooled LNG stream and a first warmed, second refrigerant stream.

2. The method of paragraph 1, wherein at least a portion of the cooled second refrigerant stream is further cooled by exchanging heat with the first warmed, second refrigerant stream to form the additionally cooled, second refrigerant stream and the second warmed, second refrigerant stream.

3. The method of paragraph 2, wherein the second warmed, second refrigerant stream is compressed to form the compressed second refrigerant stream.

4. The method of any one of paragraphs 1-3, wherein the compressed first refrigerant stream comprises at least 90 mol % methane.

5. The method of any one of paragraphs 1-4, wherein the compressed second refrigerant stream comprises at least 95 mol % nitrogen.

6. The method of any one of paragraphs 1-5, wherein the first refrigeration system is a closed loop gas phase refrigeration cycle.

7. The method of any one of paragraphs 1-6, wherein the second refrigeration system is a closed loop gas phase refrigeration cycle, and wherein the second refrigerant comprises nitrogen gas.

8. The method of any one of paragraphs 1-7, wherein the first temperature range is −70° C. to −110° C.

9. The method of any one of paragraphs 1-8, wherein the second temperature range is −130° C. to −175° C.

10. The method of any one of paragraphs 1-9, wherein the sub-cooled LNG stream is expanded to a pressure greater than or equal to 50 psia to less than or equal to 450 psia to produce an expanded, sub-cooled LNG stream.

11. The method of any one of paragraphs 1-10, wherein the sub-cooled LNG stream is expanded within a hydraulic turbine.

12. The method of any one of paragraphs 1-11, wherein at least a portion of the expanded, sub-cooled LNG stream is further expanded and then directed to a separation tank from which liquid natural gas is withdrawn and remaining gaseous vapors are withdrawn as flash gas.

13. The method of any one of paragraphs 1-12, wherein the feed gas stream is compressed to a pressure no greater 3,500 psia and then cooled by indirect heat exchange with an ambient temperature air or water prior to cooling the feed gas stream to the first temperature range.

14. The method of any one of paragraphs 1-13, wherein the feed gas stream is cooled to a temperature below the ambient temperature by indirect heat exchange within an external cooling unit prior to cooling the feed gas stream by exchanging heat with the expanded first refrigerant stream.

15. The method of any one of paragraphs 1-14, wherein the cooled first refrigerant stream is cooled to a temperature below an ambient temperature by indirect heat exchange within an external cooling unit prior to expanding the cooled first refrigerant stream.

16. The method of any one of paragraphs 1-15, wherein the warmed first refrigerant stream is compressed to form the compressed first refrigerant stream.

17. A method for liquefying a feed gas stream rich in methane using a first refrigeration system having a first refrigerant and a second refrigeration system having a second refrigerant, the method comprising:

a. providing the feed gas stream at a pressure less than 1,200 psia;

b. providing a compressed first refrigerant stream with a pressure greater than or equal to 1,500 psia, wherein the first refrigerant stream comprises the compressed first refrigerant stream;

c. cooling the compressed first refrigerant stream by indirect heat exchange with an ambient temperature air or water, to produce a cooled first refrigerant stream;

d. expanding the cooled first refrigerant stream in at least one work producing expander, thereby producing an expanded first refrigerant stream;

e. separating the expanded first refrigerant stream into a first expanded, first refrigerant stream and a second expanded, first refrigerant stream;

f. cooling the feed gas stream to within a first temperature range by exchanging heat with the first expanded, first refrigerant stream to form a liquefied feed gas stream, wherein the first expanded, first refrigerant stream only exchanges heat with the feed gas stream to form a first warmed, first refrigerant stream;

g. providing a compressed second refrigerant stream, comprising the second refrigerant, and cooling the compressed second refrigerant stream by indirect heat exchange with an ambient temperature air or water, to thereby produce a cooled second refrigerant stream;

h. further cooling at least a portion of the cooled second refrigerant stream by exchanging heat with the second expanded, first refrigerant stream, to thereby form an additionally cooled, second refrigerant stream and a second warmed, first refrigerant stream;

i. expanding the additionally cooled, second refrigerant stream to form an expanded second refrigerant stream; and j. cooling the liquefied feed gas stream to within a second temperature range by exchanging heat with the expanded second refrigerant stream, to thereby form a sub-cooled LNG stream and a first warmed, second refrigerant stream.

18. The method of paragraph 17, wherein at least a portion of the cooled second refrigerant stream is further cooled by exchanging heat with the first warmed, second refrigerant stream to form the additionally cooled, second refrigerant stream.

19. The method of paragraph 18, wherein the cooled second refrigerant stream exchanges heat with the second expanded, first refrigerant stream and with the first warmed, second refrigerant stream within a second heat exchanger.

20. The method of paragraph 19, wherein the second heat exchanger comprises one or more brazed aluminum type heat exchangers.

21. The method of any one of paragraphs 17-20, wherein the feed gas stream exchanges heat with the first expanded, first refrigerant stream within a first heat exchanger.

22. The method of paragraph 21, wherein the first heat exchanger comprises one or more brazed aluminum type heat exchangers.

23. The method of any one of paragraphs 17-22, wherein the liquefied feed gas stream exchanges heat with the expanded second refrigerant stream within a third heat exchanger.

24. The method of paragraph 23, wherein the third heat exchanger comprise one or more brazed aluminum type heat exchangers.

25. The method of any one of paragraphs 19, 21 or 23, wherein the first heat exchanger, the second heat exchanger and the third heat exchanger comprise the same one or more brazed aluminum type heat exchangers.

26. The method of any one of paragraphs 17-25, wherein the temperature, pressure and/or flow rate of the first expanded, first refrigerant stream is controlled to achieve a set point temperature for the first warmed, first refrigerant stream.

27. The method of any one of paragraphs 17-26, wherein the temperature and pressure of the first expanded, first refrigerant stream, the first warmed, first refrigerant stream, and the feed gas stream are used to estimate the temperature of the liquefied feed gas stream.

28. A method for liquefying a feed gas stream rich in methane using a first refrigeration system having a first refrigerant and a second refrigeration system using a second refrigerant, the method comprising:

a. providing the feed gas stream at a pressure less than 1,200 psia;

b. providing a compressed first refrigerant stream with a pressure greater than or equal to 1,500 psia, wherein the compressed first refrigerant stream comprises the first refrigerant;

c. cooling the compressed first refrigerant stream by indirect heat exchange with an ambient temperature air or water, to produce a cooled first refrigerant stream;

d. expanding the cooled first refrigerant stream in at least one work producing expander, thereby producing an expanded first refrigerant stream;

e. cooling the feed gas stream to within a first temperature range by exchanging heat only with the expanded first refrigerant stream, to thereby form a liquefied feed gas stream and a warmed first refrigerant stream;

f. providing a compressed second refrigerant stream, comprising the second refrigerant, and cooling the compressed second refrigerant stream by indirect heat exchange with an ambient temperature air or water, to thereby produce a cooled second refrigerant stream;

g. further cooling the cooled second refrigerant stream by exchanging heat with a first warmed, second refrigerant stream and then separating the further cooled second refrigerant stream into a first cooled, second refrigerant stream and second cooled, second refrigerant stream;

h. further cooling the first cooled, second refrigerant stream by continuing to exchange heat with the first warmed, second refrigerant stream, to thereby produce a first additionally cooled, second refrigerant stream;

i. further cooling the second cooled, second refrigerant stream by exchanging heat with the expanded first refrigerant stream, to thereby produce a second additionally cooled, second refrigerant stream;

j. combining the first additionally cooled, second refrigerant stream and the second additionally cooled, second refrigerant stream and then expanding the combined streams to thereby form an expanded second refrigerant stream; and k. cooling the liquefied feed gas stream to within a second temperature range by exchanging heat with the expanded second refrigerant stream, to thereby form a sub-cooled LNG stream and the first warmed, second refrigerant stream.

29. The method of paragraph 28, wherein the feed gas stream exchanges heat with the first expanded, first refrigerant stream within a first heat exchanger.

30. The method of paragraph 29, wherein the first heat exchanger comprise one or more spiral wound type heat exchangers.

31. The method of paragraph 30, wherein the second cooled, second refrigerant stream exchanges heat with the expanded first refrigerant stream within the first heat exchanger.

32. The method of paragraph 28, wherein the cooled second refrigerant stream exchanges heat with the first warm, second refrigerant stream within a second heat exchanger.

33. The method of paragraph 32, wherein the second heat exchanger comprises one or more spiral wound type heat exchangers.

34. The method of paragraph 33, wherein the first cooled, second refrigerant stream exchanges heat with the first warmed, second refrigerant stream within the second heat exchanger.

35. The method of paragraph 28, wherein the liquefied feed gas stream exchanges heat with the expanded second refrigerant stream within a third heat exchanger.

36. The method of paragraph 35, wherein the third heat exchanger comprises one or more spiral wound type heat exchangers.

37. The method of paragraphs 32 and 35, wherein the second heat exchanger and the third heat exchanger comprise the same one or more spiral wound type heat exchangers.

38. A method for liquefying a feed gas stream using a first refrigerant stream in a first refrigeration system and a second refrigerant stream in a second refrigeration system, the method also using a first heat exchanger zone and a second heat exchanger zone, the method comprising:

(a) providing the feed gas stream at a pressure less than 1,200 psia;

(b) providing a compressed first refrigerant stream with a pressure greater than or equal to 1,500 psia;

(c) cooling the compressed first refrigerant stream by indirect heat exchange with an ambient temperature air or water to produce a cooled first refrigerant stream;

(d) directing the cooled first refrigerant stream to the second heat exchanger zone to additionally cool the cooled first refrigerant stream below ambient temperature to produce an additionally cooled, first refrigerant stream;

(e) expanding the additionally cooled, first refrigerant stream in at least one work producing expander, thereby producing an expanded first refrigerant stream;

(f) separating the expanded first refrigerant stream into a first expanded, first refrigerant stream and a second expanded, first refrigerant stream;

(g) cooling the feed gas stream within the first heat exchanger zone by exchanging heat with the first expanded, first refrigerant stream to form a liquefied feed gas stream with a temperature within a first temperature range and a first warmed, first refrigerant stream, wherein the first warmed, first refrigerant stream only exchanges heat with the feed gas stream and has a temperature that is cooler by at least 2° C. the highest fluid temperature within the first heat exchanger zone, and wherein a heat exchanger type of the first heat exchanger zone is different from a heat exchanger type of the second heat exchanger zone;

(h) combining the first warmed, first refrigerant stream and a second warmed, second refrigerant stream to produce a third warmed, first refrigerant stream;

(i) directing the third warmed, first refrigerant stream to the second heat exchanger zone to cool by indirect heat exchange the cooled first refrigerant stream thereby forming a fourth warmed, first refrigerant stream;

(j) cooling a compressed second refrigerant stream by indirect heat exchange with an ambient temperature air or water to produce a cooled second refrigerant stream;

(k) further cooling at least a portion of the cooled second refrigerant stream within the first heat exchanger zone by exchanging heat with the second expanded, first refrigerant stream to form an additionally cooled, second refrigerant stream and the second warmed, second refrigerant stream;

(l) expanding the additionally cooled, second refrigerant stream to form an expanded second refrigerant stream; and (m) cooling the liquefied feed gas stream within the first heat exchanger zone by exchanging heat with the expanded second refrigerant stream to form a sub-cooled LNG stream with a temperature within a second temperature range and a first warmed, second refrigerant stream.

39. The method of paragraph 38, wherein the compressed first refrigerant stream comprises at least 90 mol % methane.

40. The method of paragraph 38 or 39, wherein the compressed second refrigerant stream comprises at least 95 mol % nitrogen.

41. The method of any one of paragraphs 38-40, wherein the first refrigeration system is a closed loop gas phase refrigeration cycle.

42. The method of any one of paragraphs 38-41, wherein the second refrigeration system is a closed loop gas phase refrigeration cycle, and wherein the second refrigerant stream comprises nitrogen gas.

43. The method of any one of paragraphs 38-42, wherein the first temperature range is −70° C. to −110° C.

44. The method of any one of paragraphs 38-43, wherein the second temperature range is −130° C. to −175° C.

45. The method of any one of paragraphs 38-44, wherein the sub-cooled LNG stream is expanded to a pressure greater than or equal to 50 psia to less than or equal to 450 psia to produce an expanded, sub-cooled LNG stream.

46. The method of any one of paragraphs 38-45, wherein the sub-cooled LNG stream is expanded within a hydraulic turbine.

47. The method of any one of paragraphs 38-46, wherein at least a portion of the expanded, sub-cooled LNG stream is further expanded and then directed to a separation tank from which liquid natural gas is withdrawn and remaining gaseous vapors are withdrawn as flash gas.

48. The method of any one of paragraphs 38-47, wherein the cooled first refrigerant stream is cooled to a temperature below an ambient temperature by indirect heat exchange within an external cooling unit prior to expanding the cooled first refrigerant stream.

49. The method of any one of paragraphs 38-48, wherein the warmed first refrigerant stream is compressed to form the compressed first refrigerant stream.

50. The method of any one of paragraphs 38-49, wherein a temperature, pressure and/or flow rate of the first expanded, first refrigerant stream is controlled to achieve a set point temperature for the first warmed, first refrigerant stream.

51. The method of any one of paragraphs 38-50, wherein a temperature and pressure of the first expanded, first refrigerant stream, the first warmed, first refrigerant stream, and the feed gas stream are used to estimate the temperature of the liquefied feed gas stream.

52. The method of any one of paragraphs 38-51, wherein at least one of the first heat exchanger zone and the second heat exchanger zone comprises one or more brazed aluminum type heat exchangers.

53. The method of any one of paragraphs 38-52, wherein the first warmed, first refrigerant stream has a temperature that is cooler by at least 2° C. than the highest fluid temperature within the first heat exchanger zone.

54. The method of any one of paragraphs 38-53, wherein a heat exchanger type of the first heat exchanger zone is different from a heat exchanger type of the second heat exchanger zone.

It should be understood that the numerous changes, modifications, and alternatives to the preceding disclosure can be made without departing from the scope of the disclosure. The preceding description, therefore, is not meant to limit the scope of the disclosure. Rather, the scope of the disclosure is to be determined only by the appended claims and their equivalents. It is also contemplated that structures and features in the present examples can be altered, rearranged, substituted, deleted, duplicated, combined, or added to each other.

What is claimed is:

1. A method for liquefying a feed gas stream using a first refrigerant stream in a first refrigeration system and a second refrigerant stream in a second refrigeration system, the method comprising:

(a) providing the feed gas stream at a pressure less than 1,200 psia;

(b) providing a compressed first refrigerant stream with a pressure greater than or equal to 1,500 psia;

(c) cooling the compressed first refrigerant stream by indirect heat exchange with ambient temperature air or water to produce a cooled first refrigerant stream;

(d) directing the cooled first refrigerant stream to a first heat exchanger in a second heat exchanger zone to additionally cool the cooled first refrigerant stream below ambient temperature to produce an additionally cooled, first refrigerant stream;

(e) expanding the additionally cooled, first refrigerant stream in at least one work producing expander, thereby producing an expanded first refrigerant stream;

(f) separating the expanded first refrigerant stream into a first expanded, first refrigerant stream and a second expanded, first refrigerant stream;

(g) cooling the feed gas stream in a second heat exchanger in a first heat exchanger zone by exchanging heat with the first expanded, first refrigerant stream to form a liquefied feed gas stream having a temperature within a first temperature range and a first warmed, first refrigerant stream, wherein the first expanded, first refrigerant stream only exchanges heat with the feed gas stream in the second heat exchanger;

(h) combining the first warmed, first refrigerant stream and a second warmed, first refrigerant stream obtained from the second expanded, first refrigerant stream to produce a third warmed, first refrigerant stream;

(i) directing the third warmed, first refrigerant stream to the first heat exchanger in the second heat exchanger zone to additionally cool by indirect heat exchange the cooled first refrigerant stream, thereby forming a fourth warmed, first refrigerant stream;

(j) cooling a compressed second refrigerant stream by indirect heat exchange with ambient temperature air or water to produce a cooled second refrigerant stream;

(k) further cooling at least a portion of the cooled second refrigerant stream in a third heat exchanger and a fourth heat exchanger in the first heat exchanger zone by exchanging heat with the second expanded, first refrigerant stream and a first warmed, second refrigerant stream in the fourth heat exchanger, and by exchanging heat with the first warmed, second refrigerant stream in the third heat exchanger to form an additionally cooled, second refrigerant stream and the second warmed, first refrigerant stream obtained from the fourth heat exchanger, and a second warmed, second refrigerant stream obtained from the third heat exchanger, the second warmed, second refrigerant stream being provided to a compressor to form the compressed second refrigerant stream;

(l) expanding the additionally cooled, second refrigerant stream to form an expanded second refrigerant stream; and (m) cooling the liquefied feed gas stream in a fifth heat exchanger in the first heat exchanger zone by exchanging heat with the expanded second refrigerant stream to form a sub-cooled LNG stream having a temperature within a second temperature range and the first warmed, second refrigerant stream, the first warmed, second refrigerant stream being provided sequentially to the fourth heat exchanger and then to the third heat exchanger.

2. The method of claim 1, wherein a temperature, pressure and/or flow rate of the first expanded, first refrigerant stream is controlled to achieve a set point temperature for the first warmed, first refrigerant stream.

3. The method of claim 1, wherein the first warmed, first refrigerant stream has a temperature that is cooler by at least 2° C. than a highest fluid temperature within the first heat exchanger zone.

* * * * *